US007903994B2

(12) United States Patent
Matsumoto et al.

(10) Patent No.: US 7,903,994 B2
(45) Date of Patent: Mar. 8, 2011

(54) IMAGE FORMING APPARATUS

(75) Inventors: Hiroyuki Matsumoto, Mishima (JP); Takayuki Kato, Kashiwa (JP); Seiji Obata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 432 days.

(21) Appl. No.: 12/118,322

(22) Filed: May 9, 2008

(65) Prior Publication Data

US 2008/0286001 A1 Nov. 20, 2008

(30) Foreign Application Priority Data

May 15, 2007 (JP) ..... 2007-129251
Mar. 25, 2008 (JP) ..... 2008-077498

(51) Int. Cl.
*G03G 15/04* (2006.01)
*G03G 15/00* (2006.01)
*G03G 21/16* (2006.01)

(52) U.S. Cl. ..... 399/98; 399/32; 399/110; 399/111; 399/118; 399/206

(58) Field of Classification Search ..... 399/98, 399/110, 111, 118
See application file for complete search history.

(56) References Cited

U.S. PATENT DOCUMENTS

| | | | | |
|---|---|---|---|---|
| 7,269,379 | B2 * | 9/2007 | Nakanishi | 399/122 |
| 7,509,071 | B2 * | 3/2009 | Yoshimura et al. | 399/111 |
| 2005/0047822 | A1 * | 3/2005 | Hashimoto et al. | 399/111 |
| 2005/0069342 | A1 * | 3/2005 | Kanno et al. | 399/111 |
| 2006/0018680 | A1 * | 1/2006 | Hosokawa et al. | 399/111 |
| 2006/0083544 | A1 * | 4/2006 | Okabe | 399/111 |
| 2007/0041744 | A1 * | 2/2007 | Gumbe | 399/111 |
| 2007/0071495 | A1 * | 3/2007 | Hashimoto et al. | 399/111 |

(Continued)

FOREIGN PATENT DOCUMENTS

| | | | |
|---|---|---|---|
| CN | 1743978 A | | 3/2006 |
| JP | 03221473 A | * | 9/1991 |
| JP | 2004-085899 A | | 3/2004 |

(Continued)

OTHER PUBLICATIONS

Chinese Notification of the First Office Action dated Dec. 11, 2009 in Chinese Application No. 200810099243.X, and an English-language translation therefor.

*Primary Examiner* — David M Gray
*Assistant Examiner* — Francis Gray
(74) *Attorney, Agent, or Firm* — Fitzpatrick, Cella, Harper & Scinto

(57) ABSTRACT

An image forming apparatus for forming an image on a recording material, to which apparatus a process cartridge is detachably mountable, wherein said process cartridge includes a photosensitive drum unit and a developing unit, wherein said photosensitive drum unit includes a photosensitive drum, and said developing unit is rotatably engageable with said photosensitive drum unit and includes a developing roller for developing an electrostatic latent image formed on said photosensitive drum, and wherein said developing unit is movable between a contact position in which said developing roller is in contact to said photosensitive drum and a spaced position in which said developing roller is spaced from said photosensitive drum, said image forming apparatus including means for exposing said photosensitive drum with light through a transmission member to form the electrostatic latent image, wherein said exposure means is positioned below said process cartridge when said process cartridge is mounted to a main assembly of the apparatus; moving means for moving said developing unit to the contact position or to the spaced position; and a cleaning member for cleaning said transmission member in interrelation with an operation of said moving means.

16 Claims, 18 Drawing Sheets

U.S. PATENT DOCUMENTS

| | | | | |
|---|---|---|---|---|
| 2007/0091657 | A1* | 4/2007 | Uchitani | 363/65 |
| 2008/0044201 | A1* | 2/2008 | Nakahata | 399/121 |
| 2008/0138109 | A1* | 6/2008 | Anan et al. | 399/113 |
| 2008/0205951 | A1* | 8/2008 | Ueda et al. | 399/345 |

FOREIGN PATENT DOCUMENTS

| | | | | |
|---|---|---|---|---|
| JP | 2005-41017 | A | | 2/2005 |
| JP | 2008209876 | A | * | 9/2008 |
| JP | 2008310293 | A | * | 12/2008 |

* cited by examiner (a)

(b)

IMAGE FORMING APPARATUS

FIELD OF THE INVENTION AND RELATED ART

The present invention relates to an image forming apparatus which has an electrophotographic image forming means.

Japanese Laid-open Patent Application 2004-085899 discloses a technology for not only preventing a transparent dust cover (glass dust cover) in an image forming apparatus from being soiled, but also, for cleaning the transparent dust cover. This technology concerns the operation for covering and cleaning the glass dust cover with which the optical unit of an image forming apparatus is provided, by utilizing the operation carried out for unblocking the path for the image writing beam of light, which needs to be unblocked for image formation, when a process cartridge which holds image forming means and is removably mountable in an image forming apparatus is replaced.

Structuring an image forming apparatus as described above makes it possible to prevent the problem that the powdery debris and toner mist, which are created when a process cartridge is replaced, adhere to the glass dust cover. It also makes it possible to remove the powdery debris and toner particles having accumulated on the glass dust cover prior to the process cartridge replacement operation.

The present invention is a further development of the above-described image forming apparatus structure, that is, the image forming apparatus structure in accordance with the prior art.

It is not unusual that a minute amount of toner scatters from a development roller when an image is formed. Further, in order to prevent the surface layer of the photosensitive drum from being shaved, and also, to prevent the developing device from deteriorating, the developing device is kept separated from the photosensitive drum when it is not used for development. Therefore, the developing device is repeatedly separated and placed in contact with the photosensitive drum, being therefore subjected to the shocks which occur as the developing device is separated from, or placed in contact with, the photosensitive drum. These shocks also causes a small amount of toner to fall or scatter from a process cartridge. Moreover, as sheets of paper are conveyed in an image forming apparatus, paper dust is discharged into the internal space of the image forming apparatus. This paper dust settles, along with the dust in the air, in the image forming apparatus. Therefore, an electrophotographic image forming apparatus is provided with a dust (toner) filter to prevent the above-mentioned scattered or settled toner, and the settled paper dust, from being discharged from the image forming apparatus. However, a minute amount of toner and dust remain floating in the internal space of the apparatus. Thus, the toner particles and powdery debris adhere to the glass dust cover even when a process cartridge is not replaced.

As toner particles and powdery debris adhere to the glass dust cover, they partially block the beam of laser light when the beam of light is transmitted through the glass dust cover. That is, the adhesion of toner particles and powdery debris affects an image forming apparatus in optical properties. More specifically, it causes an image forming apparatus to decline in the level of quality at which the image forming apparatus forms an image. In particular, in a case of an image forming apparatus whose optical unit is in the bottom portion of its main assembly, and also, whose exposure opening faces upward, it is more likely for the glass dust cover to be soiled by the dust, such as toner particles and powdery debris.

SUMMARY OF THE INVENTION

Thus, the primary object of the present invention, which is related to an image forming apparatus in which a process cartridge whose photosensitive drum and development roller can be placed in contact with, or separated from, each other, and is removably mountable, is to prevent toner from adhering to the transparent member of the exposing means, with the utilization of the means for separating the developing roller from the photosensitive drum, or placing the development roller in contact with the photosensitive drum.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a few of the preferred embodiments of the present invention will be described in more detail with reference to the appended drawings.

Embodiment 1

Figure 1:
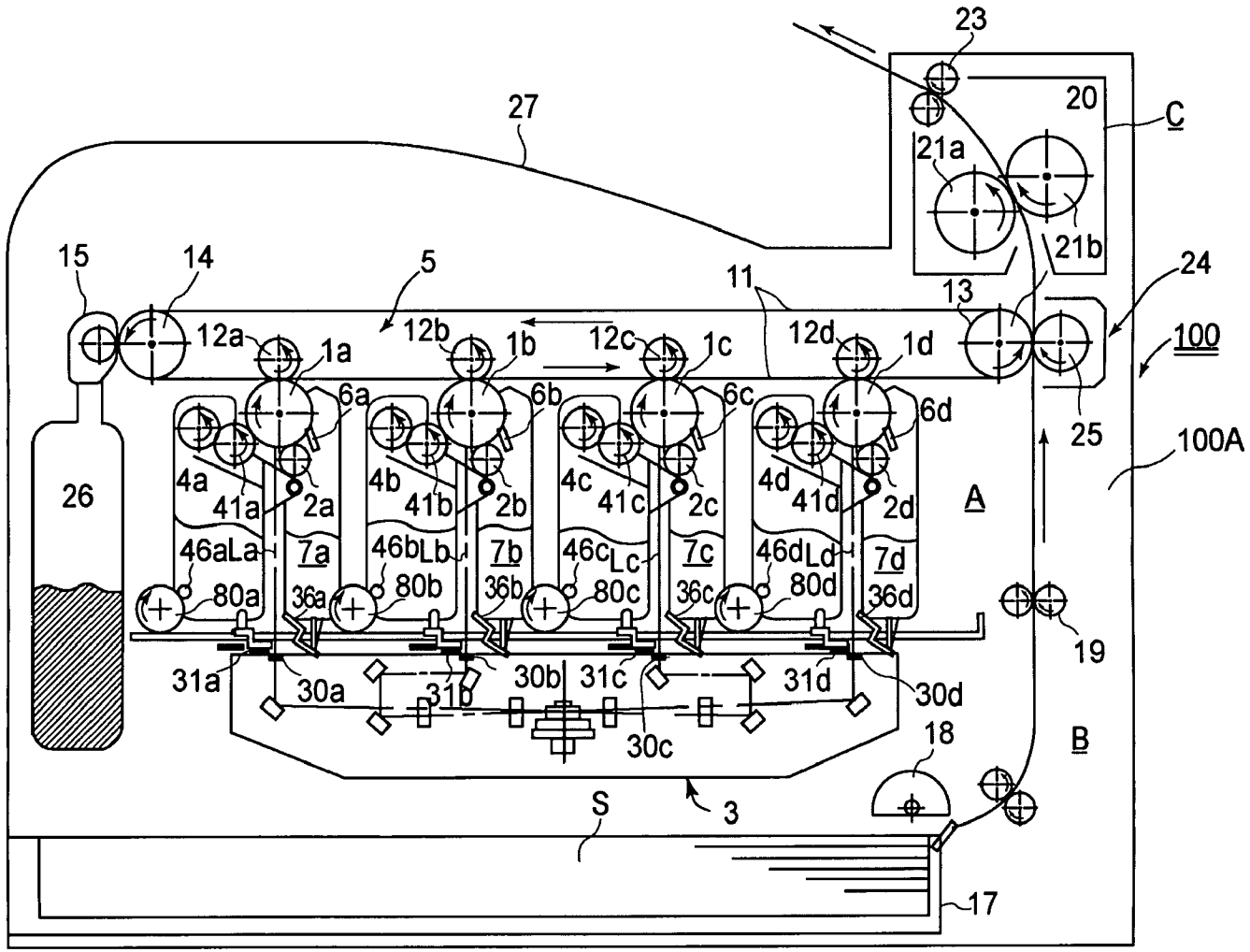
FIG. 1 is a schematic sectional view of the image forming apparatus in the first embodiment of the present invention.
Figure 2:
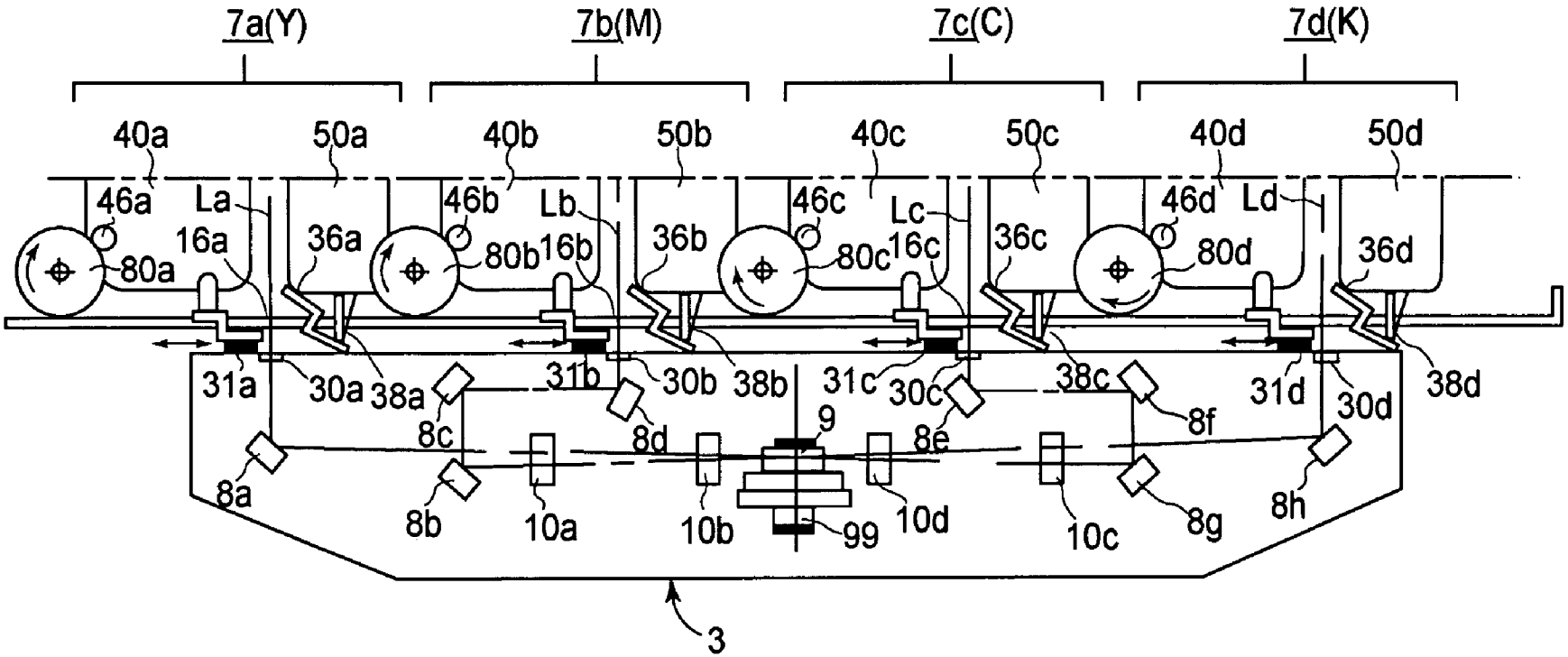
FIG. 2 is an enlargement of one of the essential portions of FIG. 1.
Figure 3:
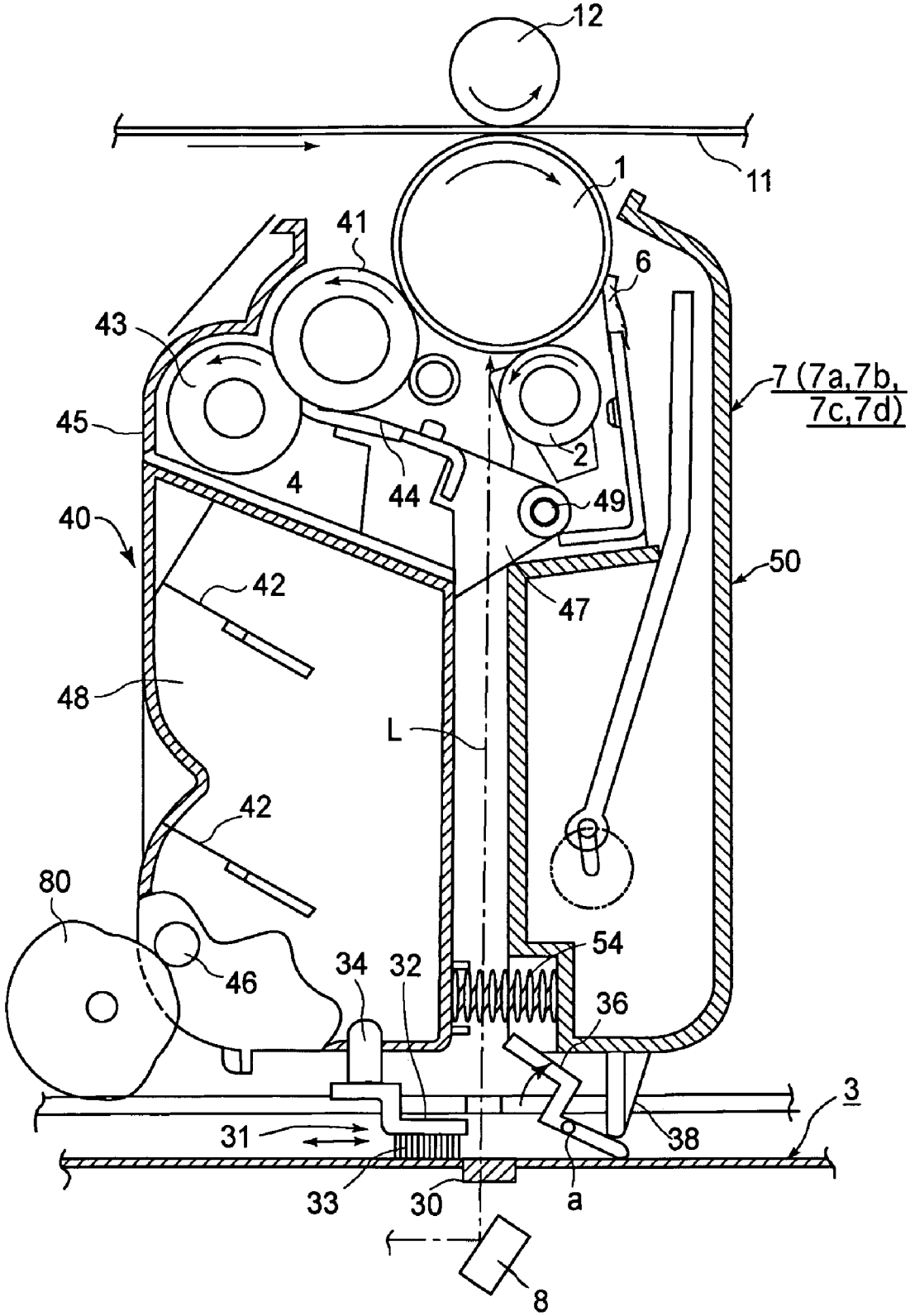
FIG. 3 is an enlargement of another essential portion of FIG. 1.

FIG. 1 is a schematic sectional view of the image forming apparatus 100 in this embodiment of the present invention. FIG. 2 is an enlargement of one of the essential areas of FIG. 1. FIG. 3 is an enlarged schematic sectional view of one of the process cartridges in the image forming portions.

This image forming apparatus 100 uses an electrophotographic process. It is a full-color laser printer, which uses four toners different in color. It forms an image on a sheet of recording medium S, in response to electrical pictorial signals inputted from an external host apparatus (not shown), such as a personal computer, an image reader, a facsimile machine, etc.

[General Structure of Image Forming Apparatus]

Referring mainly to FIG. 1, generally speaking, this image forming apparatus 100 is made up of an image forming portion A, a paper feeding-and-conveying portion B, and a fixing portion C. The image forming portion A is in the middle portion of the apparatus. The paper feeding-and-conveying portion B extends from the bottom right portion to the top right portion of the apparatus. The fixing portion C is in the top right corner of the apparatus.

(1) Image Forming Portion A

The image forming portion A is provided with four photosensitive drums 1 (first to fourth drums 1*a*, 1*b*, 1*c*, and 1*d*), which are horizontally (left to right) arranged in tandem. Each photosensitive drum is an electrophotographic photosensitive member in the form of a drum, which functions as an image bearing member. It is rotatable. Hereafter, this electrophotographic photosensitive member will be referred to simply as a photosensitive drum 1. Further, the image forming portion A is provided with four charging apparatuses 2 (2*a*, 2*b*, 2*c*, and 2*d*), an exposing apparatus 3, four developing apparatuses 4 (4*a*, 4*b*, 4*c*, and 4*d*), an intermediary transfer unit 5, four cleaning apparatuses 6 (6*a*, 6*b*, 6*c*, and 6*d*), etc.

1) Photosensitive Drum 1

Each photosensitive drum 1 is made up of an aluminum cylinder with a diameter of 30 mm, and an organic photoconductive layer (photosensitive layer formed of OPC) coated on the peripheral surface of the aluminum cylinder. The photosensitive drum 1 is rotatably supported by its lengthwise ends, by supporting members. As driving force is transmitted from a motor (unshown driving means) to one of the lengthwise ends of the photosensitive drum 1, the photosensitive drum 1 is rotationally driven at a preset peripheral velocity in the clockwise direction of the drawings.

2) Charging Apparatus 2

Each charging apparatus 2 is a means for uniformly charging the peripheral surface of the corresponding photosensitive drum 1 to preset polarity and potential level. The charging apparatus 2 may be of the contact type. The charging member of the charging apparatus 2 in this embodiment is an electrically conductive roller. This roller is placed in contact with the peripheral surface of the photosensitive drum 1, and a preset charge bias is applied to this roller. As the preset charge bias is applied to the roller, the peripheral surface of the photosensitive drum 1 is uniformly charged to the preset polarity and potential level, as described above.

3) Exposing Apparatus 3

The exposing apparatus 3 is an exposing means for forming an electrostatic latent image on the charged peripheral surface of each photosensitive drum 1. More specifically, it projects a beam of light (optical image in accordance with pictorial data) onto the charged surface of the photosensitive drum 1, through a transparent member. The exposing apparatus 3 in this embodiment is a scanner unit, which projects beams of laser light L (La, Lb, Lc, and Ld) while modulating the beam of light with electric signals derived from the pictorial information. It is positioned below the group of the aforementioned four photosensitive drums 1.

Referring to FIG. 2, the scanner unit 3 is made up of a laser diode (not shown), a scanner motor 99, a polygon mirror 9, focusing lenses 10 (10*a*, 10*b*, 10*c*, and 10*d*), deflection mirrors 8 (8*a*-8*h*), glass dust covers 30 (30*a*, 30*b*, 30*c*, and 30*d*), etc. The glass dust cover 30 is a transparent component for protecting the interior of the exposing apparatus from foreign matter, such as dust in the air. In operation, a beam of laser light is outputted, while being modulated with pictorial signals, toward the polygon mirror 9, which is being rotated at a high speed by the scanner motor 99. Thus, this beam of light is deflected by the polygon mirror in a scanning manner. Then, it is transmitted onto the charged peripheral surface of the photosensitive drum 1, by way of the focusing lens 10, mirror 8, and glass dust cover 30, etc. Therefore, numerous points of the charged peripheral surface of the photosensitive drum 1 are selectively exposed.

As a result, an electrostatic latent image, which reflects the pattern of exposure, is effected on the peripheral surface of each photosensitive drum 1.

4) Developing Apparatus 4

Each developing apparatus 4 is a developing means, and has a development roller 41 (41*a*, 41*b*, 41*c*, or 41*d*), which is a developer bearing member to be placed in contact with the corresponding photosensitive drum 1 to develop the electrostatic latent image on the photosensitive drum 1, with the use of developer.

5) Intermediary Transfer Unit 5

The intermediary transfer unit 5 is a means for transferring (primary transfer) the toner images on the photosensitive drums 1 onto the intermediary transfer belt 11. It is positioned above the space in which the group of photosensitive drums 1 are arranged. Referring to FIG. 1, the intermediary transfer unit 5 is made up of an intermediary transfer belt 11, and a pair of parallel rollers, that is, a driver roller 13 (right one in FIG. 1) and a tension roller 14 (left one in FIG. 1). The intermediary transfer belt 11 is horizontally suspended and stretched by the two rollers 13 and 14. The intermediary transfer belt 11 is circularly driven by the driver roller 13, in the counterclockwise direction indicated by an arrow mark, at a velocity matching the peripheral velocity of the photosensitive drum 1, while remaining in contact with the upwardly facing portion of the peripheral surface of each photosensitive drum 1, by the downwardly facing portion of its outward surface. The intermediary transfer belt 11 is a flexible endless belt, which is roughly 700 mm in circumferential length, roughly 150 μm in thickness, and $10^{11}$-$10^{14}$ Ω·cm in specific volume resistivity, for example. The intermediary transfer unit 5 is also provided with four primary transfer rollers 12 (12*a*, 12*b*, 12*c*, and 12*d*), which are on the inward side of the belt loop and are arranged in tandem and also, in parallel, in a manner to oppose the four photosensitive drums 1, one for one, with the portion of the intermediary transfer belt 11, which is moving through the bottom portion of the belt loop, sandwiched between the primary transfer rollers 12 and photosensitive drums 1. The area of contact between each photosensitive drum 1 and intermediary transfer belt 11 is one of the primary transfer portions.

In this embodiment, a toner image is formed of negatively charged toner, on the peripheral surface of each photosensitive drum 1. To the primary transfer roller 12, a preset primary transfer bias voltage, which is positive in polarity, that is, opposite in polarity to the toner, is applied. As the primary transfer bias voltage is applied, the toner image on the peripheral surface of the photosensitive drum 1, that is, the toner image negative in polarity, is transferred (primary transfer) onto the intermediary transfer belt 11, in the primary transfer portion.

There is a secondary transfer unit 24, which is on the downstream side of the primary transfer portion, in terms of the moving direction of the intermediary transfer belt 11. The secondary transfer unit 24 is a unit for transferring (secondary transfer) the toner image(s) on the belt 11 onto the recording medium S. The secondary transfer unit 24 is provided with a secondary transfer roller 25, which is positioned in a manner to press on the driver roller 13 of the intermediary transfer unit 5, with the belt 11 sandwiched between itself and the driver roller 13. The area of contact between the belt 11 and secondary transfer roller 25 is the secondary transfer portion. The recording medium S is fed into the main assembly of the image forming apparatus by a paper feeding-and-conveying portion B, and then, is conveyed to the second transfer portion, by the paper feeding-and-conveying portion B. Then, the recording medium S is conveyed through the secondary transfer portion while remaining sandwiched by the secondary transfer roller 25 and belt 11. While the recording medium S is conveyed through the secondary transfer portion, a preset secondary transfer voltage, which is positive in polarity, that is, opposite in polarity from the toner, is continuously applied. As a result, the toner image(s) on the belt 11, that is, the toner image(s) having just been transferred (primary transfer) onto the belt 11, are transferred (secondary transfer) onto the recording medium S.

Further, the intermediary transfer unit 5 is provided with a cleaning apparatus 15, which is for removing the toner remaining on the belt 11 after the secondary transfer. The cleaning apparatus 15 is positioned in such a manner that it presses on the tension roller 14, with the belt 11 sandwiched between the cleaning apparatus 15 and tension roller 14. Waste toner, that is, the toner having been removed from the belt 11 by the belt cleaning apparatus 15, is conveyed further through a waste toner conveyance path, and then, is recovered into a waste toner recovery bin 26.

6) Cleaning Apparatus 6

In this embodiment, each cleaning apparatus 6 (6*a*, 6*b*, 6*c*, and 6*d*) is provided with a cleaning blade, which is placed in contact with the peripheral surface of the corresponding photosensitive drum 1 in such a manner that, in terms of the rotational direction of the photosensitive drum 1, its cleaning edge is on the upstream side of its base. The cleaning blade scrapes the peripheral surface of the photosensitive drum 1, causing thereby the toner on the peripheral surface of the photosensitive drum 1 to fall therefrom.

7) Process Cartridge 7

In this embodiment, a first process cartridge 7*a* is made up of a first photosensitive drum 1*a*, a charging apparatus 2*a*, a developing apparatus 4*a*, a cleaning apparatus 6*a*, and a housing (cartridge), in which the preceding components are integrally disposed. The charging apparatus 2*a*, developing apparatus 4*a*, and cleaning apparatus 6*a* are means for processing the first photosensitive drum 1*a*. The first process cartridge 7*a* is removably mountable in the main assembly 100A of the image forming apparatus 100.

A second process cartridge 7*b* is made up of a second photosensitive drum 1*b*, a charging apparatus 2*b*, a developing apparatus 4*b*, a cleaning apparatus 6*b*, and a housing (cartridge), in which the preceding components are integrally disposed. The charging apparatus 2*b*, developing apparatus 4*b*, and cleaning apparatus 6*b* are means for processing the second photosensitive drum 1*b*. The second process cartridge 7*b* is removably mountable in the main assembly 100A of the image forming apparatus 100.

A third process cartridge 7*c* is made up of a third photosensitive drum 1*c*, a charging apparatus 2*c*, a developing apparatus 4*c*, a cleaning apparatus 6*c*, and a housing (cartridge), in which the preceding components are integrally disposed. The charging apparatus 2*c*, developing apparatus 4*c*, and cleaning apparatus 6*a* are means for processing the third photosensitive drum 1*c*. The third process cartridge 7*c* is removably mountable in the main assembly 100A of the image forming apparatus 100.

A fourth process cartridge 7*d* is made up of a second photosensitive drum 1*d*, a charging apparatus 2*d*, a developing apparatus 4*d*, a cleaning apparatus 6*d*, and a housing (cartridge), in which the preceding components are integrally disposed. The charging apparatus 2*d*, developing apparatus 4*d*, and cleaning apparatus 6*d* are means for processing the fourth photosensitive drum 1*d*. The fourth process cartridge 7*d* is removably mountable in the main assembly 100A of the image forming apparatus 100.

The apparatus main assembly 100A is the portion of the image forming apparatus 100 which remains after the removal of the process cartridges 7 (7*a*, 7*b*, 7*c*, and 7*d*) from the image forming apparatus 100. In the following description of the present invention, the lengthwise direction of the process cartridge 7, its structural components, etc., is the same as the direction of the axial line of the photosensitive drum 1, or the direction parallel to the axial line of the photosensitive drum 1.

The apparatus main assembly 100A is provided with a mechanism (not shown) for removably mounting each cartridge 7 in the apparatus main assembly 100A; each cartridge 7 is removably mounted in its preset position in the apparatus main assembly 100A. While each cartridge 7 is in its preset position in the apparatus main assembly 100A, it is rigidly held in the position, with its driving force input portion kept in contact with the driving force output portion of the apparatus main assembly 100A, and with the electrical contacts of the process cartridge 7 remaining in contact with the power supply system of the apparatus main assembly 100A.

The first to fourth cartridges 7 are the same in structure, although they are different in the color of the developer (toner) contained therein. That is, the first cartridge 7*a* contains yellow (Y) developer in its developer storage portion, and forms an image of yellow developer, on the photosensitive drum 1*a*. The second cartridge 7*b* contains magenta (M) developer in its developer storage portion, and forms an image of magenta developer, on the photosensitive drum 1*b*. The third cartridge 7*c* contains cyan (C) developer in its developer storage portion, and forms an image of cyan developer, on the photosensitive drum 1*c*. The fourth cartridge 7*d* contains black (K) developer in its developer storage portion, and forms an image of black developer, on the photosensitive drum 1*d*.

Referring to FIGS. 2 and 3, each cartridge 7 is made up of a photosensitive member unit 50 (50*a*, 50*b*, 50*c*, or 50*d*), and a development unit 40 (40*a*, 40*b*, 40*c*, or 40*d*). The photosensitive drum unit 50 is made up of the photosensitive drum 1, charging apparatus 2, and cleaning apparatus 6. The development unit 40 is made up of the developing apparatus 4, etc. The photosensitive drum unit 50 and development unit 40 are connected to each other, with the use of a pair of connective pins 49 (or a connective shaft) (FIG. 3), being enabled to rotationally move about the connective pins 49 relative to each other.

Referring to FIG. 3, the development unit 40 has a toner container 48 and a developing means container 45. The developing means container 45 functions as the housing as well as the frame of the development unit 40. The development unit 40 also has a development roller 41, which is positioned in the developing means container 45 in such a manner that its peripheral surface directly faces the peripheral surface of the photosensitive drum 1. The development roller 41 is a member which bears and conveys the developer. The developer, that is, toner, in the toner container 48 is delivered to a toner supply roller 43 by a toner conveying-and-stirring mechanism 42. As toner is delivered to the toner supply roller 43, it is coated, while being given electrical charge, on the peripheral surface of the development roller 41 by the toner supply roller 43, and a development blade 44, which is kept pressed upon the peripheral surface of the development roller 41. Thus, as development bias is applied to the development roller 41, the latent image on the photosensitive drum 1 is developed by the electrically charged toner on the development roller 41, into a visible image formed of the toner. That is, the development roller 41 develops the latent image on the photosensitive drum 1 by coming into contact with the photosensitive drum 1 (by placing toner on development roller 41 in contact with photosensitive drum 1).

The development unit 40 is provided with a pair of bearings 47, which are attached to the lengthwise ends of the development unit 40, one for one. It is connected to the photosensitive drum unit 50 with the aforementioned connective pins 49 put through the bearings 47, being suspended by the connective pins 49 so that it is rotationally movable about the connective pins 49 relative to the photosensitive drum unit 50. Further, a pair of compression springs 54 (elastic members) are positioned between the development unit 40 and photosensitive drum unit 50, keeping thereby the development unit 40 pressed in the direction to cause the development unit 40 to rotate in such a manner that the development roller 41 is kept in contact with the photosensitive drum 1. Thus, even when the cartridge 7 is not in the apparatus main assembly 100A, the development unit 40 and photosensitive drum unit 50 are kept pressed relative to each other by the compression springs 54 in a manner to cause them to rotate about the pair of connective pints 49.

When each cartridge 7 is in its preset position in the apparatus main assembly 100A, the photosensitive drum unit 50 is precisely and rigidly held relative to the apparatus main assembly 100A, whereas the development unit 40 is allowed to rotationally move relative to the rigidly held photosensitive drum unit 50 about the connective pins 49.

The toner container 48 of the development unit 40 of each cartridge 7 is provided with a boss 46 (46*a*, 46*b*, 46*c*, and 46*d*), which is integrally formed with the toner container 48, whereas the apparatus main assembly 100A is provided with cams 80 (80*a*, 80*b*, 80*c*, and 80*d*), which are the portions of the means for separating, and keeping separated, the development roller 41 from the photosensitive drum 1. The boss 46 is the portion of the toner container 48, which catches the force applied to the development unit 40 by the cam 80 of the apparatus main assembly 100A. The means for separating, or keeping separated, the development roller 41 from the photosensitive drum 1 will be described later in detail. Hereafter, this means will be referred to simply as the separating means.

Regarding the positioning of the development unit 40 relative to the photosensitive drum unit 50 after the mounting of the cartridge 7 into its preset position in the apparatus main assembly 100A, in an image forming operation, the compression springs 54 keep the development unit 40 and photosensitive drum unit 50 in their positions, shown in FIGS. 1-3, and therefore, the development roller 41 is kept in contact with the photosensitive drum 1. When the development unit 40 and photosensitive drum unit 50 are in the state shown in FIGS. 1-3, the beam of laser light L projected from the scanner unit 3 is allowed to enter upward into the process cartridge 7 through the gap between the development unit 40 and photosensitive drum unit 50, and expose the portion of the peripheral surface of the photosensitive drum 1, which is facing downward.

Further, the development unit 40 is provided with a system for detecting the amount of the toner remaining in the toner container 48 (which hereafter will be referred to as toner remainder amount detection system), although it is not shown in the drawings. The toner remainder amount detection system detects the amount of the toner remainder in the toner container 48, by projecting a beam of the light from an LED into the toner container 48, and measuring the length of time the beam of light is allowed to transmit through the toner container 48. More specifically, as each cartridge 7 is used for image formation, the developer (toner) in its toner container 48 is consumed. Thus, the development unit 40 is provided with the toner remainder amount detection system, which is controlled by the control portion of the image forming apparatus 100. The control portion compares the length of time the beam of light was allowed to transmit through the toner container 48, with a preset threshold value for triggering the issuance of a message or warning that informs a user (operator) of the estimated length of the remaining life of the cartridge 7. If the detected length of time the beam of light was allowed to transmit through the toner container 48 of a given cartridge 7 is more than the threshold value A, the control portion displays on a monitor portion of the apparatus, a message or warning that informs a user (operator) of the estimated length of the remaining life of the cartridge 7, prompting thereby the user to prepare a replacement cartridge, or to ensure that the image forming apparatus 100 remains at a preset level in terms of image quality.

Figure 4:
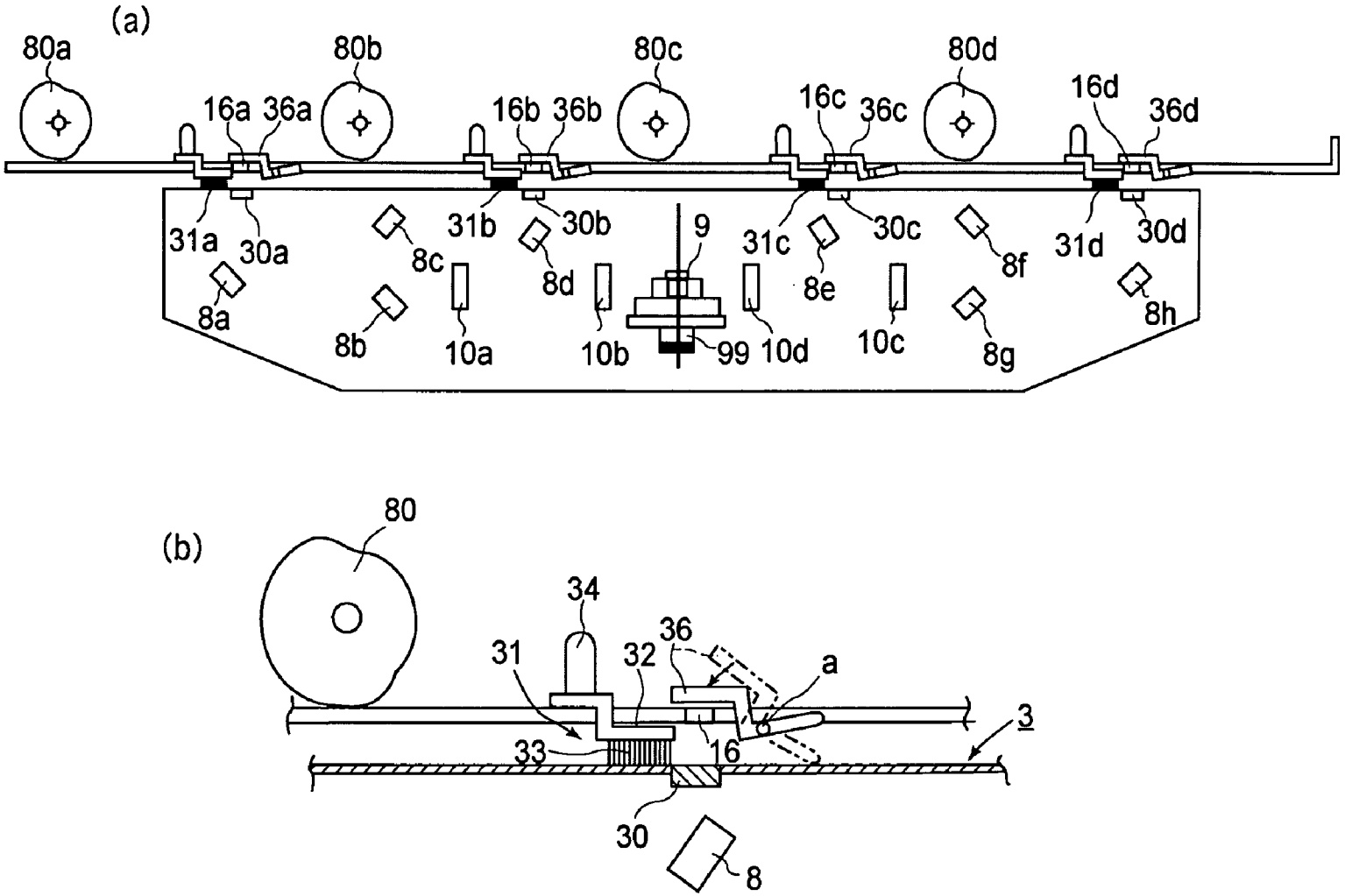
FIG. 4 is a schematic sectional view of the portion shown in FIG. 2, in which process cartridges are not present.

There is a covering member 36 (36*a*, 36*b*, 36*c*, or 36*d*) on the top side of each glass dust cover 30. The covering member 36 is for covering the slit 16 (16*a*, 16*b*, 16*c*, or 16 *d*) through which the beam of laser light L is allowed to enter the cartridge 7. The covering member 36 is rotatably supported by a shaft a (FIG. 3), being allowed to take a position in which it keeps the slit 16 exposed, and a position in which it keeps the slit 16 covered (FIG. 4).

As the cartridge 7 is mounted into the apparatus main assembly 100A, the arm side of the covering member 36, which is the side which catches the force delivered by the cartridge 7, is pressed by a projection 38 (38*a*, 38*b*, 38*c*, or 38*d*) which projects downward from the surface of the photosensitive drum unit 50, which faces downward when the cartridge 7 is in the apparatus main assembly 100A. As a result, the arm side of the covering member 36 rotationally moves downward about the shaft a, causing thereby the covering member 36 to move into the position, shown in FIGS. 1-3, in which it leaves the slit 16 exposed, and in which it is kept while the cartridge 7 is its preset position in the apparatus main assembly 100A. Exposing the slit 16 makes it possible to expose the peripheral surface of the photosensitive drum 1 to form an electrostatic latent image on the peripheral surface of the photosensitive drum 1.

On the other hand, when the cartridge 7 is not in the apparatus main assembly 100A, the arm side of the covering member 36 is not pressed by the projection 38 of the cartridge 7. Therefore, the covering member 36 remains in the position shown in FIG. 4, in which it keeps the slit 16 covered, by the moment generated by its own weight in a manner to rotate about the shaft a.

Designated by a referential numeral 31 (31*a*, 31*b*, 31*c*, or 31*d*) is a cleaning member for cleaning the top surface of the glass dust cover 30 by rubbing the surface. The cleaning member 31 will be described later in detail.

(2) Paper Feeding-and-Conveying Portion B

The paper feeding-and-conveying portion B is the portion of the apparatus main assembly 100A, which feeds the recording medium S into the apparatus main assembly 100A, and then, conveys the recording medium S to the secondary transfer portion, in which the images on the belt 11 are transferred onto the recording medium S. The paper feeding-and-conveying portion B is made up of a paper feeder cassette 17 and a feed roller 18 (semicylindrical roller). The paper feeder cassette 17 holds multiple recording mediums S, such as transfer papers, in layers. In an image forming operation, the topmost recording medium S in the paper feeder cassette 17 is fed into the apparatus main assembly 100A by the feed roller 18, and is moved further into the apparatus main assembly 100A. Then, as its front edge comes into contact with a pair of registration rollers 19, the recording medium S is kept on standby by the registration rollers 19, bowing therefore in such a manner that its center portion displaces in the direction perpendicular the direction in which it is conveyed. Then, the recording medium S is released, and conveyed to the secondary transfer portion, by the registration rollers 19, so that the writing start line of the recording medium S arrives at the secondary transfer portion at the same time as the front edge of the toner image on the belt 11.

(3) Fixing Portion C

The fixing portion C is the portion of the apparatus main assembly 100A, which fixes the unfixed multiple toner images, different in color, on the recording medium S, to the recording medium S. It has a heat roller 21*a*, and a pressure roller 21*b*, which is kept pressed against the heat roller 21*a* to apply heat and pressure to the recording medium S and the toner images thereon.

There is a pair of paper discharge rollers 23 on the downstream side of the fixation unit 20 in terms of the recording medium conveyance direction. The discharge rollers 23 discharge the recording medium S into a delivery tray 27, which is an integral part of the top wall of the external shell of the image forming apparatus 100.

Further, there is a paper (sheet) sensor (not shown) between the fixation unit 20 and the pair of discharge rollers 23. The paper sensor monitors whether the recording medium S has been successfully discharged or has wrapped around the heat roller 21*a* or pressure roller 21*b*.

After the transfer of the toner images from the belt 11 onto the recording medium S, the recording medium S is conveyed through the fixation unit 20 by the pair of fixation rollers, that is, the heat roller 21*a* and pressure roller 21*b*, while being given heat and pressure by the pair of fixation rollers 21*a* and 21*b*. As a result, the multiple toner images, different in color, on the recording medium S are permanently fixed to the surface of the recording medium S.

(4) Image Forming Operation

As a command to start an image forming operation is inputted, the first to fourth cartridges 7*a*, 7*b*, 7*c*, and 7*d* sequentially begin to be driven in synchronism with printing timing. As a result, the first to fourth photosensitive drums 1*a*, 1*b*, 1*c*, and 1*d* are rotationally driven in the clockwise direction. As each photosensitive drum 1 is rotationally driven, its peripheral surface is uniformly charged by the charge roller 2. Further, the scanner unit 3 is driven, which faces all the cartridges 7 in the apparatus main assembly 100A. It exposes the charged portion of the peripheral surface of the photosensitive drum 1 in response to pictorial signals, effecting thereby an electrostatic latent image on the peripheral surface of the photosensitive drum 1. The development roller 41 in the developing apparatus 4 forms (develops) a toner image on the peripheral surface of the photosensitive drum 1, by transferring toner onto the numerous points of the electrostatic image, which are lower in potential level. The toner image on the peripheral surfaces of each photosensitive drum 1 is transferred (primary transfer) onto the belt 11, in synchronism with the movement of a referential marker with which the belt 11 is provided. As all the toner images, different in color, are transferred (primary transfer) in vertical alignment, onto the belt 11, a single full-color image is effected on the belt 11.

More specifically, on the drum 1*a* of the first cartridge 7*a*, a visible image of yellow color, which corresponds to the yellow component of a full-color image, is formed of the yellow developer. This visible image formed of the yellow developer is transferred (primary transfer) onto the belt 11. On the drum 1*b* of the second cartridge 7*b*, a visible image of magenta color, which corresponds to the magenta component of a full-color image, is formed of the magenta developer. This visible image formed of the magenta developer is layered (primary transfer) onto the yellow image on the belt 11, in alignment with the yellow image. On the drum 1*c* of the third cartridge 7*c*, a visible image of cyan color, which corresponds to the cyan component of a full-color image, is formed of the cyan developer. This visible image formed of the cyan developer is layered (primary transfer) onto the yellow and magenta images on the belt 11 in alignment with the yellow and magenta images on the belt 11. On the drum 1*d* of the fourth cartridge 7*d*, a visible image of black color, which corresponds to the black component of a full-color image, is formed of the black developer. This visible image formed of the black developer is layered (primary transfer) onto the yellow, magenta, and cyan images on the belt 11 in alignment with the yellow, magenta, and cyan images on the belt 11. As a result, an unfixed full-color image is synthetically effected by the four monochromatic images, that is, the yellow, magenta, cyan, and black monochromatic images formed of the yellow, magenta, cyan, and black developers, on the belt 11.

The rotation of the pair of registration rollers 19 is started to deliver the recording medium S to the secondary transfer portion, with such a timing that the front edge of the full-color image on the belt 11 reaches the area of contact (secondary transfer portion) between the belt 11 and secondary transfer roller 25, at the same time as the print start line of the recording medium S.

While the recording medium S is conveyed through the secondary transfer portion, the full-color toner image on the belt 11 is transferred onto the recording medium S by the electric field formed between the belt 11 and secondary transfer roller 25.

After the transfer of the full-color toner image onto the recording medium S, the recording medium S is conveyed from the secondary transfer portion to the fixation unit 20, in which the unfixed full-color toner image is thermally fixed. Thereafter, the recording medium S is discharged by the pair of discharge rollers 23, with the image bearing surface of the recording medium facing downward, from the paper discharging portion onto the delivery tray 27, which is an integral part of the top wall of the external housing (frame) of the apparatus main assembly 100A.

[Separating Means]

The apparatus main assembly 100A is provided with a means 90 for separating the development roller 41 (developing apparatus 4) from the photosensitive drum 1, in each cartridge 7, or placing the development roller 41 (developing apparatus 4) in contact with the photosensitive drum 1, in each cartridge 7. This means hereafter will be referred to simply as a separating means 90. When the image forming apparatus 100 is not forming an image, the separating means 90 keeps the development roller 41 separated from the photosensitive drum 1, minimizing thereby the amount by which the surface layer of the photosensitive drum 1 is shaved by the development roller 41, and minimizing the amount by which the development roller 41 deteriorates.

Figure 5:
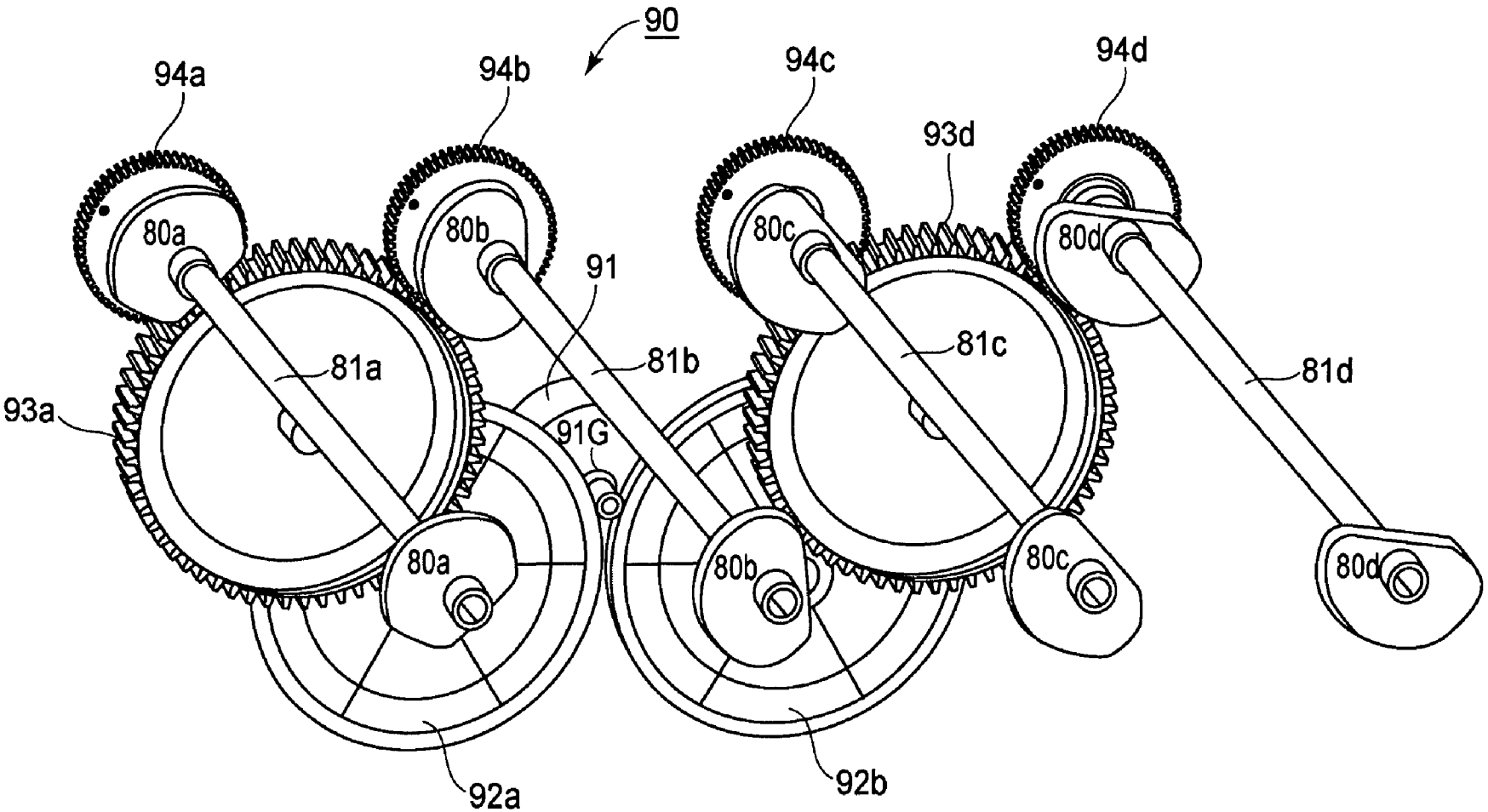
FIG. 5 is a perspective view of the mechanism for separating the development rollers from the corresponding photosensitive drums, or placing the developing apparatuses in contact with the corresponding photosensitive drums.

FIG. 5 is a perspective view of the separating means 90. The apparatus main assembly 100A is provided with four cams 80 (80*a*, 80*b*, 80*c*, and 80*d*) for rotating the development unit 40 about the connective pins 49 in the direction to separate the development roller 41 in the development unit 40 from the photosensitive drum 1 in the photosensitive drum unit 50. These cams 80 hereafter will be referred to as separation cams 80. The separation cams 80 are positioned so that when the cartridges 7 are in their preset positions in the apparatus main assembly 100A, each separation cam 80 is next to the bottom left corner of the corresponding cartridge 7. Designated by a referential symbol 81 (81*a*, 81*b* 81*c*, or 81*d*) is a shaft, to the front and rear ends of which a pair of the separation cams 80, which are the same in size, profile, and rotational phase, are attached, one for one.

The separation cam 80 causes the separation boss 46, which is the force catching portion of the development unit 40, to move left or right. More specifically, as the separation cam 80 moves the separation boss 46 leftward or rightward, the development unit 40 is rotated about the connective pins 49 in the direction to separate the development roller 41 from the photosensitive drum 1, or to place the development roller 41 in contact with the photosensitive drum 1, respectively. Hereafter, the position in which the development unit 40 is when the photosensitive drum 1 is in contact with the development roller 41 will be referred to as the contact position, whereas the position in which the development roller 41 is when the photosensitive drum 1 remains separated from the development roller 41 will be referred to as the separation position.

Referring to FIG. 5, the separation cams 80 (80*a*, 80*b*, 80*c*, and 80*d*) are rotated by a stepping motor 91, which is a driving means, through gear trains 91G•92 (92*a*, 92*b*), 93 (93*a*, 93*b*), 94 (94*a*, 94*b*, 94*c*, and 94*d*), correspondingly. As each separation cam 80 is rotated, the separation boss 46 of the corresponding development unit 40 is moved left or right, moving the development unit 40 into the contact position, that is, the position in which the development roller 41 remains in contact with the photosensitive drum 1, or allowing the development unit 40 to return to the separation position, that is, the position in which the development roller 41 remains separated from the photosensitive drum 1.

In this embodiment, the separating means 90 is structured so that the image forming apparatus can be placed in three different operational modes 1)-3) by controlling the separation cams 80 in their angle of rotation.

Figure 6:
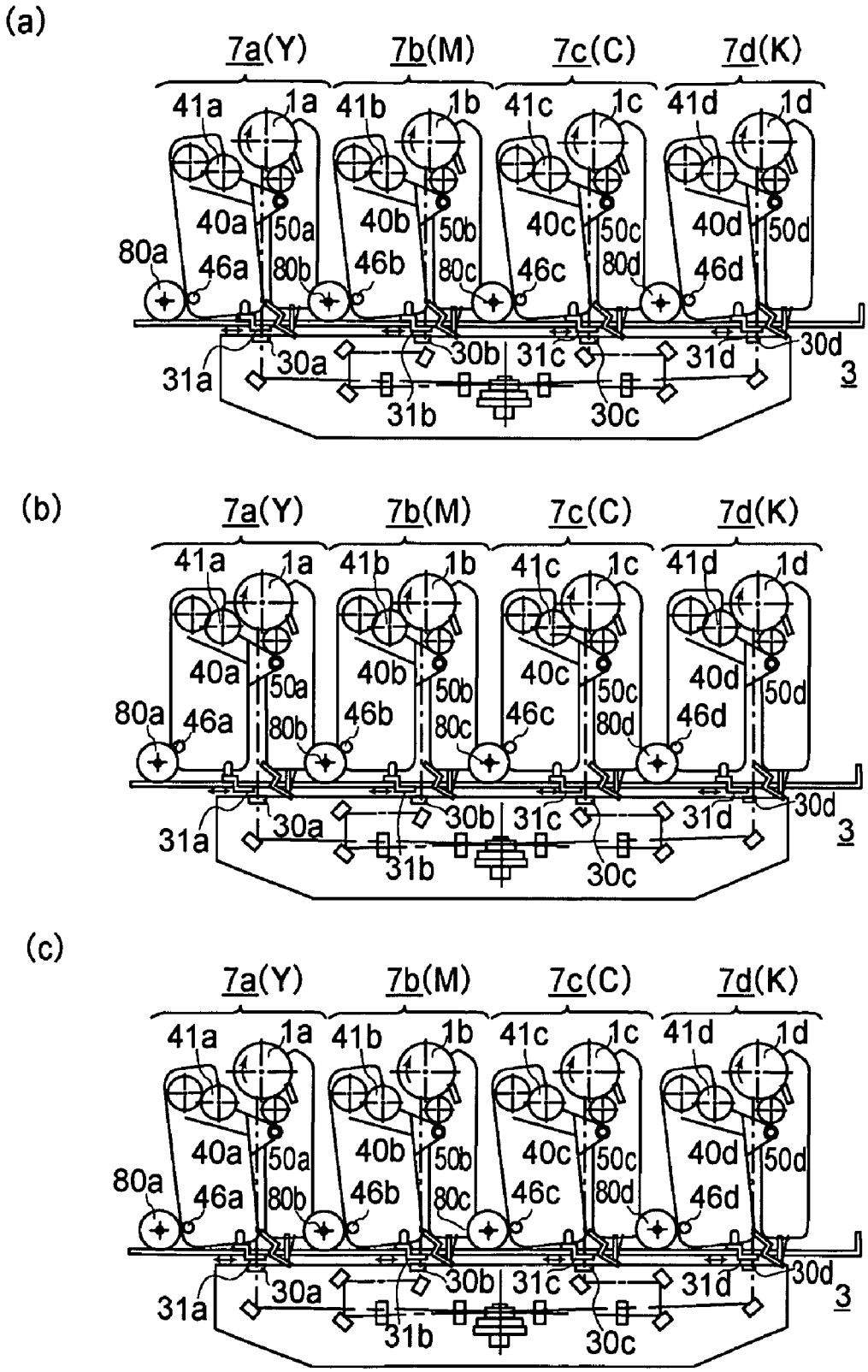
FIGS. 6(*a*), 6(*b*), and 6(*c*) are schematic sectional views of the image forming portions of the image forming apparatus in the first embodiment, when the image forming apparatus is on standby, when the image forming apparatus is forming an image in the full-color mode, and when the image forming apparatus is forming an image in the black-and-white mode, respectively.

Mode a (Standby Mode): The portion of the peripheral surface of the separation cam 80 of each of the first to fourth cartridges 7, which is largest in the distance from the rotational axis of the cam 80, is placed in contact with the separation boss 46, as shown in FIG. 6(*a*).

Mode b (Full-Color Mode): The portion of the peripheral surface of the separation cam 80 of each of the first to fourth cartridges 7, which is smallest in the distance from the rotational axis of the cam 80, is placed in contact with the corresponding separation boss 46, as shown in FIG. 6(*b*), to keep the image forming apparatus 100 in the full-color mode.

Mode c (Black-and-White Mode): The portion of the peripheral surface of the separation cam 80 of each of the first to third cartridges 7 (for yellow, magenta, and cyan color, respectively), which is largest in the distance from the rotational axis of the cam 80, is placed in contact with the corresponding separation boss 46, as shown in FIG. 6(*c*), to keep the corresponding development roller 41 separated from the photosensitive drum 1, in order to keep the yellow, magenta, and cyan image forming portions on standby, whereas the portion of the peripheral surface of the separation cam 80 of the fourth cartridge 7 (for black color), which is smallest in the distance from the rotational axis of the cam 80, is placed in contact with the corresponding separation boss 46, as shown in FIG. 6(*c*), to keep the image forming apparatus 100 in the black-and-white mode, in which the development roller 41 of the fourth cartridge 7 (for black color) is kept in contact with the corresponding photosensitive drum 1.

In the full-color mode, the development rollers 41*a*, 41*b*, 41*c*, and 41*d* of the first (yellow), second (magenta), third (cyan), and fourth (black) cartridges 7 are sequentially placed in contact with the corresponding photosensitive drums 1, in the listed order, to develop the electrostatic latent images on the photosensitive drums 1, respectively.

Then, the development rollers 41*a*, 41*b*, 41*c*, and 41*d* of the first (yellow), second (magenta), third (cyan), and fourth (black) cartridges 7 are sequentially separated from the corresponding photosensitive drums 1, in the listed order, as the development of the electrostatic latent images on the corresponding photosensitive drums 1 are sequentially completed, respectively, ending thereby the printing operation.

That is, the first to fourth cartridges 7 are made different in rotational phase of the separation cam 80 in the same manner, as the first to fourth cartridges 7 are made different in the timing with which their separation cams 80 are rotated into the separation position, or rotated out of the contact position; the separation cams 80*a*, 80*b*, 80*c*, and 80*d* are made different in rotational phase.

Further, the means for driving the development roller 41 is provided with a development clutch (not shown), which is a means for allowing or preventing the transmission of driving force to the development roller 41. This development clutch is designed so that the rotation of the development roller 41 can be started or stopped while the photosensitive drum 1 is rotated. In this embodiment, a single motor is shared by the photosensitive drum driving means and development roller driving means of each cartridge 7.

Therefore, for the purpose of minimizing the shaving of the surface layer of the photosensitive drum 1, and the deterioration of the development roller 41, it is possible to control the image forming apparatus 100 so that it is only when an electrostatic latent image on the photosensitive drum 1 needs to be developed that the development roller 41 begins to be driven, and then, is placed in contact with the photosensitive drum 1.

[System for Cleaning Optical Components]

Next, the system for cleaning the glass dust cover of the scanner unit 3 will be described.

If foreign matter, such as dust, adheres to optical components, it is impossible to form an electrostatic latent image of high quality, on the photosensitive drum 1. In particular, in the case of an image forming apparatus, such as the image forming apparatus whose optical means is in its bottom portion, the toner particles having scattered and/or fallen from the cartridge 7 are likely to adhere to the glass dust cover 30. Therefore, an image forming apparatus, such as the image forming apparatus in this embodiment, is provided an airtight optical means case, in which the optical components, such as the polygon mirror 9, focusing lens 10, and deflection mirror 8, are sealed. The airtight optical means case is provided with multiple openings through which the beam of laser light can be transmitted. Each opening is fitted with the glass dust cover 30.

Further, the apparatus main assembly 100A is provided with cleaning members 31 (31*a*, 31*b*, 31*c*, and 31*d*) for cleaning the glass dust covers 30 (30*a*, 30*b*, 30*c*, and 30*d*). The cleaning members 31 are positioned above the above-mentioned airtight optical means case of the scanner unit 3. More specifically, the cleaning members 31 (31*a*, 31*b*, 31*c*, and 31*d*) are located above the glass dust covers 30 (30*a*, 30*b*, 30*c*, and 30*d*), respectively, of the scanner unit 3.

Figure 7:
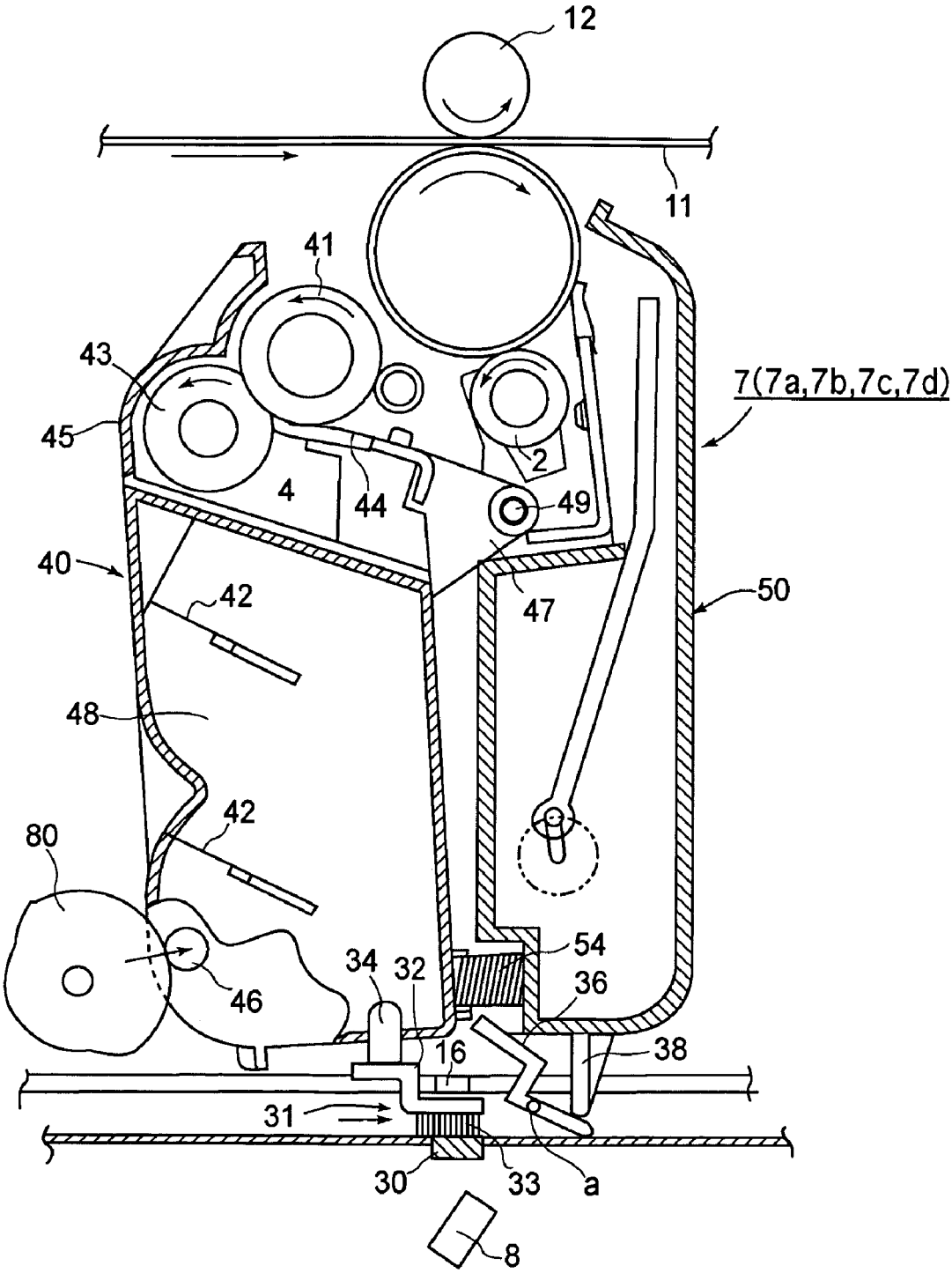
FIG. 7 is a schematic sectional view of the process cartridge whose development roller is not in contact with its photosensitive drum.

In this embodiment, each cleaning member 31 is a cleaning brush made up of a base plate 32 (FIG. 3) and a bundle of bristles 33. The base plate 32 is in a form of a long and narrow rectangle. The bristles 33 are planted across one of the end portions of the base plate 32. The cleaning member 31 is positioned so that its bristles 33 can cover the entirety of the top surface of the glass dust cover 30, which covers the slit-like exposure window. The cleaning member 31 is kept pressed toward the top surface of the scanner unit 3 by unshown compression springs. It is attached to the optical unit case in such a manner that it can be moved with its bristles 33 remaining in contact with the glass dust cover 30. It is movable between a position (FIG. 3) in which it leaves the glass dust cover 30 exposed, and a position (FIG. 7) in which it keeps the glass dust cover 30 covered.

Each cleaning member 31 is provided with a pair of positioning bosses 34 (FIGS. 3 and 7), with which the cleaning member 31 engages with the development unit 40 of the corresponding cartridge 7. The positioning bosses 34 are at the lengthwise ends of the cleaning member 31, one for one. In order to ensure that the positioning bosses 34 engage with the development unit 40 when the cartridge 7 is mounted into the apparatus main assembly 100A, the tip of each positioning boss 34 is rounded.

That is, the image forming apparatus 100 is structured so that as the development unit 40 is rotationally moved relative to the photosensitive drum unit 50 by the separating means 90 (as developing apparatus is separated from, or placed in contact with, photosensitive drum 1), the glass dust covers 30 are cleaned. In other words, the image forming apparatus 100 is structured so that as the development roller 41 is moved in the direction to separate from the photosensitive drum 1, or in the direction to come into contact with the photosensitive drum 1, the cleaning member 31 is moved, cleaning thereby the glass dust cover 30.

With the image forming apparatus 100 structured as described above, when the cartridge 7 is mounted into the apparatus main assembly 100A, the separation boss 46 of the development unit 40 comes into contact with the portion of peripheral surface of the separation cam 80, which is largest in distance from the axial line of the cam 80, causing thereby the development roller 41 to separate from the photosensitive drum 1. When the cartridge 7 is in this condition, the cleaning member 31 is in engagement with the development unit 40, and also, in contact with the top surface of the glass dust cover 30, covering the entirety of the glass dust cover 30, as shown in FIGS. 6(*a*) and 7. Then, as an image forming operation is started by the inputting of a print start signal, most of the motors begin to rotate. Then, the stepping motor 91 begins to rotate, rotating thereby the separation cam 80 by a preset angle. As the separation cam 80 rotates, it pushes the separation boss 46 of the development unit 40, causing thereby the development unit 40 to rotate in the clockwise direction about the connective pins 49 until the development unit 40 stops in the contact position, that is, the position in which it keeps the development roller 41 in contact with the photosensitive drum 1. Then, the image forming operation begins.

The cleaning member 31 is moved by the movement of the development unit 40, which is transmitted to the cleaning member 31 through the positioning boss 34 (by which cleaning member engages with development unit 40). That is, as the development unit 40 is moved as described above, the cleaning member 31 is moved by the movement of the development unit 40 from the position shown in FIGS. 6(*a*) and 7 to the position, shown in FIG. 3, in which it leaves the glass dust cover 30 exposed, while rubbing the surface of the glass dust cover 30 with its bundle of bristles 33. In other words, the movement of the development unit 40 causes the cleaning member 31 to move into the position (exposing position), in which it leaves the glass dust cover 30 exposed, keeping thereby unblocked the path for the beam of laser light L projected from the LED of the scanner unit 3. After the completion of the image forming operation, the stepping motor 91 is rotated again by another preset angle, rotating thereby the separation cam 80. This rotational movement of separation cam 80 allows the separation boss 46 to move in the direction opposite from the direction in which the separation cam 80 was moved previously, allowing thereby the development unit 40 to rotate in the counterclockwise direction about the connective pins 49 until it rotates into the separation position, that is, the position in which it keeps the development roller 41 separated from the photosensitive drum 1 by a preset distance (FIGS. 6(*a*) and 7). This movement of the development unit 40 causes the cleaning member 31 to move into the position in which the cleaning member 31 keeps the glass dust cover 30 covered. Then, all the motor are stopped to end the image forming operation.

In other words, as the developing apparatus is separated from the photosensitive drum 1, or placed in contact with the photosensitive drum 1, through the above-described preparatory steps for image formation or post-image formation steps, the contaminants adhering to the outward surface of the glass dust cover 30 are automatically removed, preventing thereby the problem that the image forming apparatus 100 is reduced in image quality by the contamination of the glass dust cover 30, which occurs when the cartridge 7 is replaced or while an image is formed.

In this embodiment, the image forming apparatus 100 and each of the cartridges 7 therefor are structured so that in order to remove the contaminants adhering to the glass dust cover 30, the cleaning member 31 is moved by the movement of the developing apparatus at the same time as the developing apparatus of each cartridge 7 is placed in contact with, or separated from, the photosensitive drum 1, by the separating means 90. Further, the cleaning member 31 is utilized as a covering member for keeping covered the slit or the like, which is for allowing the image writing beam of light projected from the scanner unit 3, to enter the cartridge 7. Therefore, it does not occur that during an operation for replacing the cartridge 7 or during an image forming operation, contaminants, such as the toner particles having scattered, or fallen, from the image forming means, and powdery debris in the apparatus main assembly 100A, adhere to the glass dust cover 30, etc.

Further, the cleaning member 31 is utilized as the covering member. In other words, the cleaning member 31 is made to play two roles, that is, the role of removing the contaminants from the glass dust cover 30, and the role of preventing contaminants from adhering to the glass dust cover 30, significantly contributing to the prevention of the soiling of the glass dust cover 30.

Figure 8:
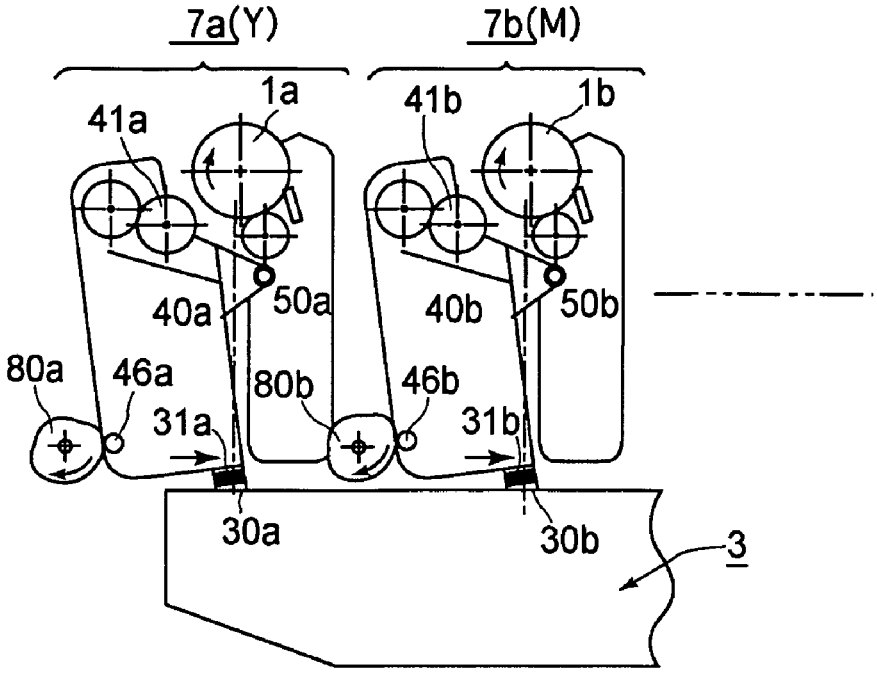
FIGS. 8(*a*) and 8(*b*) are schematic sectional views of the image forming portions which are compatible with a process cartridge provided with a cleaning member, showing the image forming portions whose development rollers are not in contact with the corresponding photosensitive members, and the image forming portions whose development rollers are in contact with the corresponding photosensitive members, respectively.
Figure 8:
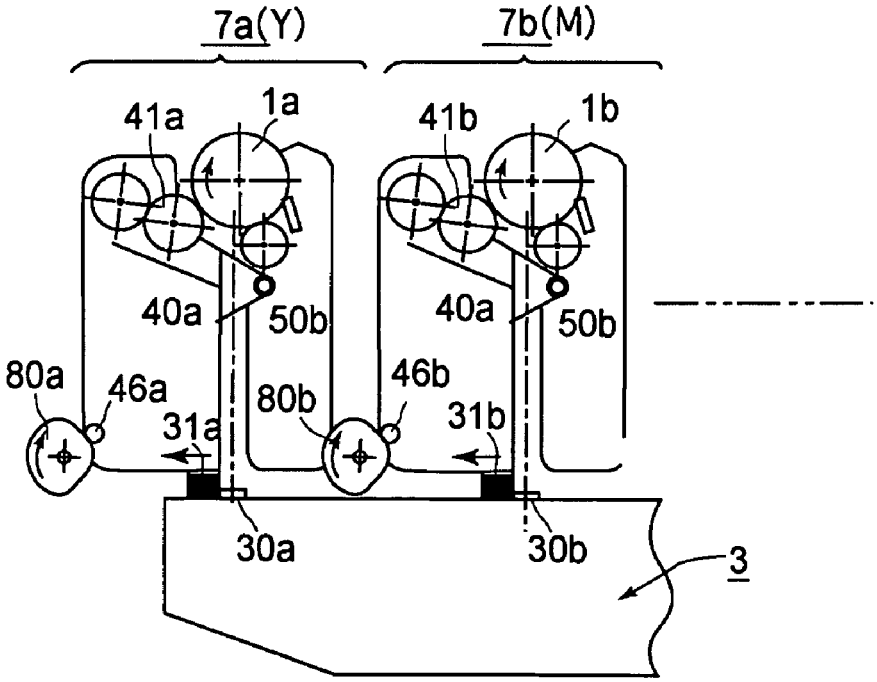

In this embodiment, the image forming apparatus 100 was structured so that the rotational movement of the development unit 40 was utilized to move the cleaning member 31 to clean the glass dust cover 30. However, this embodiment is not intended to limit the present invention in terms of the structure of an image forming apparatus. For example, the cleaning member 31 may be attached to the bottom of the development unit 40, as shown in FIG. 8, so that as the development unit 40 is rotationally moved, the glass dust cover 30 is cleaned by the cleaning member 31. With the employment of this structural arrangement, each time the cartridge 7 is replaced, the cleaning member 31 is automatically replaced. Therefore, the surface of the glass dust cover 30 is kept cleaner.

Regarding the structure of an image forming apparatus, as long as an image forming apparatus is structured so that even if the path for the image forming beam of light is directly below the image forming portion, the contamination of the glass dust cover 30 can be satisfactorily prevented by a covering member 36, the cleaning member 31, that is, a member for cleaning the surface of the glass dust cover 30, is unnecessary.

Further, instead of structuring an image forming apparatus so that the cleaning member 31 is moved to clean the glass dust cover 30, an image forming apparatus may be structured so that the cleaning member 31 remains stationary, and the contaminants of the glass dust cover 30 is removed by moving the glass dust cover 30 relative to the stationary cleaning member 31 by the movement of the development unit 40 caused by the separating means 90 in the direction to separate the developing apparatus from the photosensitive drum 1, and the movement of the development unit 40 caused by the separating means 90 in the direction to place the developing apparatus in contact with the photosensitive drum 1. That is, the gist of the present invention is to clean the glass dust cover 30 by moving the cleaning member 31, which is a cleaning means, or glass dust cover 30, which is a transparent member, relative to each other, by the movement of the development unit 40 caused by the separating means 90.

The measurement, material, and shape of each of the structural components of the image forming apparatus in this embodiment are not intended to limit the present invention in scope, unless specifically noted.

Embodiment 2

In the first embodiment described above, the image forming apparatus was structured so that the cleaning member 31 was moved by the movement of the development unit 40 to clean the glass dust cover 30, or to cover the glass dust cover 30 to block the path of the image forming beam of light, when the development unit 40 is moved to separate the development roller 41 from the photosensitive drum, or to place the development roller 41 in contact with the photosensitive drum 1.

Figure 9:
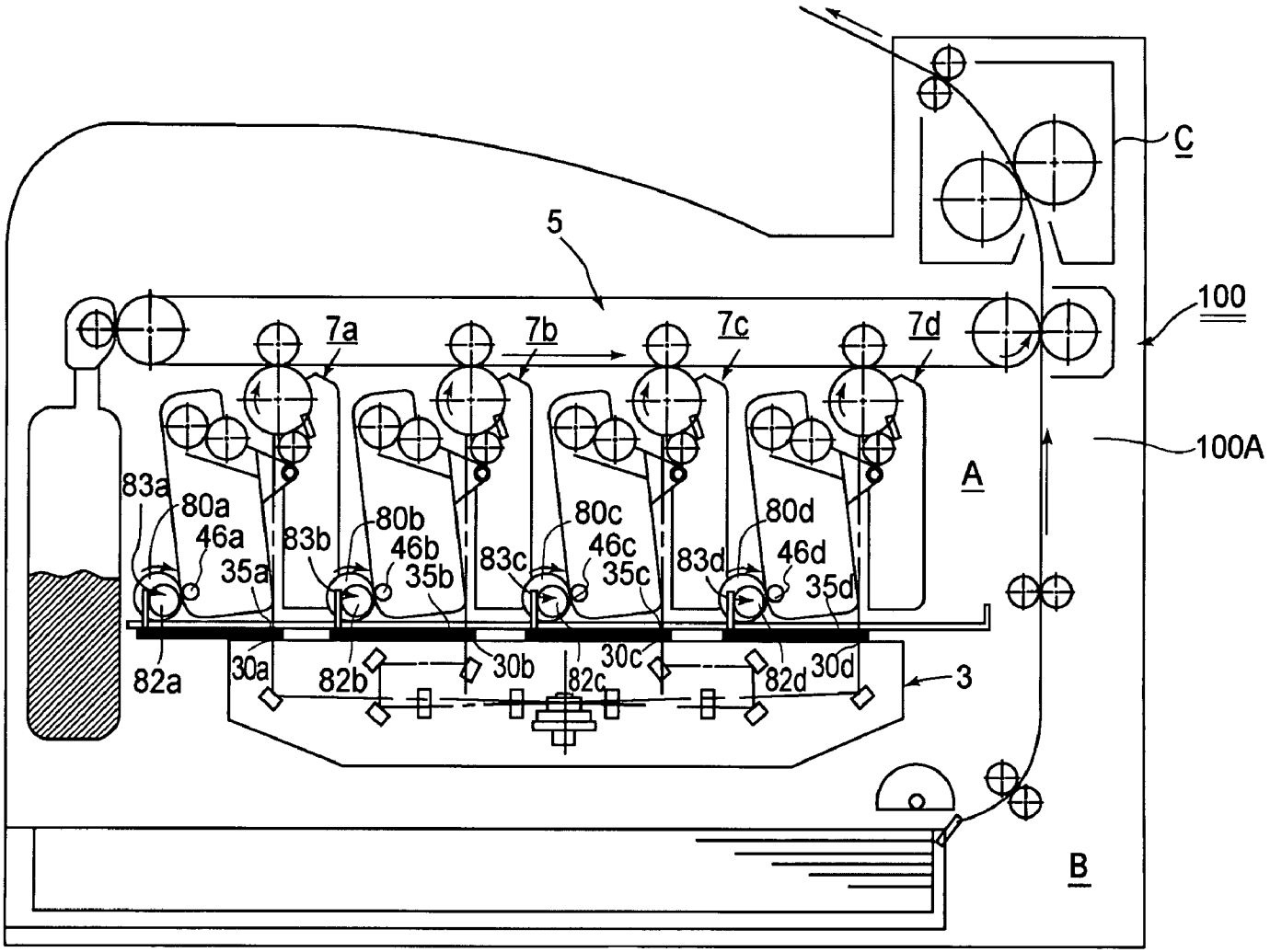
FIG. 9 is a schematic sectional view of the image forming apparatus in the second embodiment of the present invention.
Figure 10:
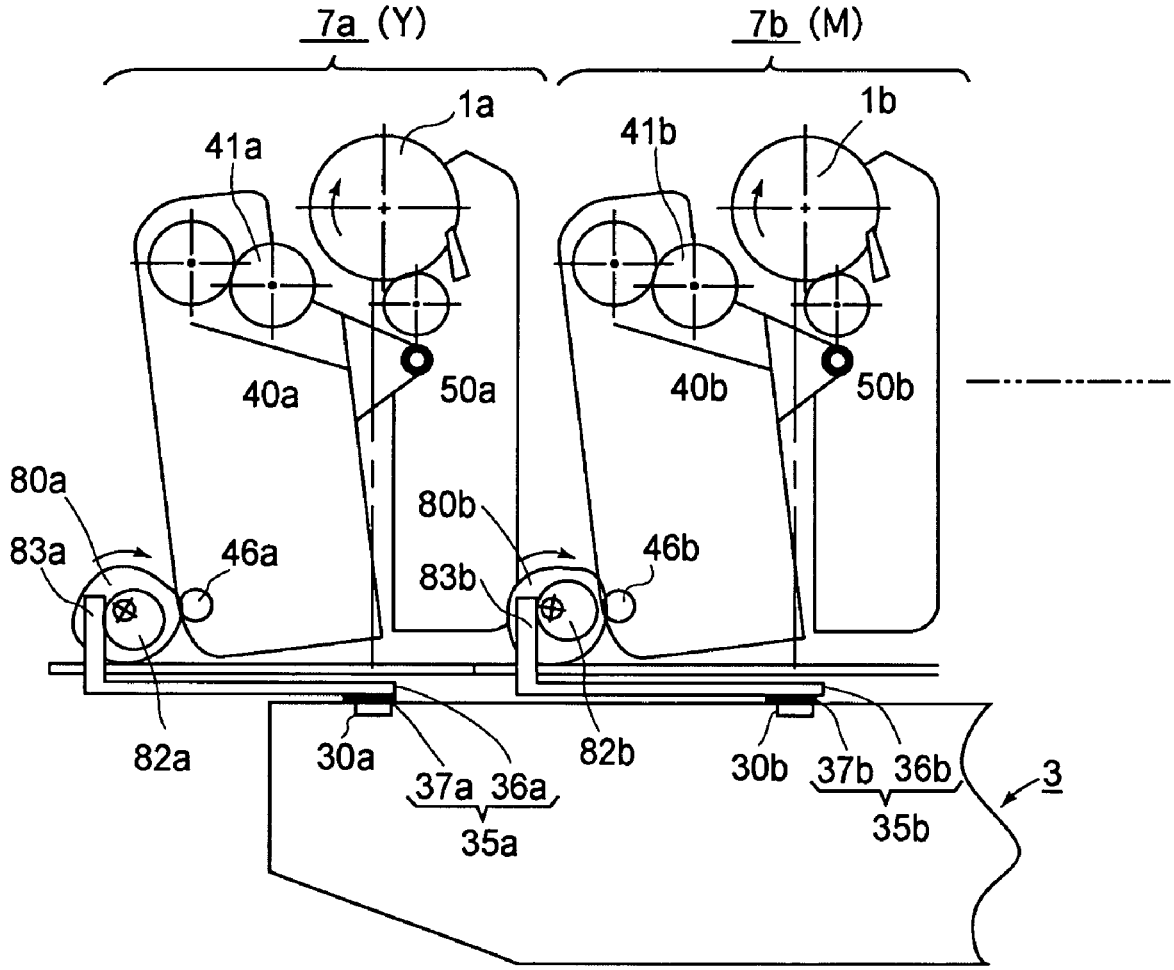
FIG. 10 is a detailed schematic sectional view of the mechanism for separating the developing apparatuses from the corresponding photosensitive drums, or placing the developing apparatuses in contact with the corresponding photosensitive drums.

In the second embodiment, the image forming apparatus is structured so that the timing with which the development roller is separated from, or placed in contact with, the photosensitive drum is different from the timing with which the glass dust cover 30 is cleaned, or covered to block the path of the image forming beam of light. Next, referring to FIGS. 9 and 10, this image forming apparatus will be described. This image forming apparatus is different from the image forming apparatus in the first embodiment only in that the transparent member 30 is cleaned before or after the development roller 41 is separated from the photosensitive drum 1. Thus, the structural components of this image forming apparatus, which are similar to the counterparts of the image forming apparatus in the second embodiment, will be given the same referential symbols as those given to the counterparts in the first embodiment, one for one, to avoid the repetition of the same description. Also in terms of general structure, and system for placing the developing apparatus in contact with the photosensitive drum 1 or separating the developing apparatus from the photosensitive drum 1, this image forming apparatus is the same as the image forming apparatus in the first embodiment. Therefore, the general structure and developing apparatus moving system of this image forming apparatus will not be described.

Also in this embodiment, the image forming apparatus is provided with cleaning-and-covering members 35 (35*a*, 35*b*, 35*c*, and 35*d*) for cleaning, or keeping covered, the glass dust covers 30 (30*a*, 30*b*, 30*c*, and 30*d*). The cleaning-and-covering members 35 are positioned above the above-mentioned airtight case of the scanner unit 3. Not only does the cleaning-and-blocking member 35 clean the glass dust cover 30, but also, functions as a cover plate which keeps the glass dust cover 30 covered to prevent the toner particles having scattered or fallen from the cartridge 7, from adhering to the glass dust cover 30 when the cartridge 7 is replaced or when the developing apparatus is kept separated from the photosensitive drum 1.

More specifically, the cleaning-and-covering member 35 is movable between its covering position in which it blocks the path through which the beam of light projected from the scanner unit 3 transmits toward the photosensitive drum 1, and its exposing position in which it leaves the path unblocked. The cleaning-and-covering member 35 is moved by the movement of the separating means. The cleaning-and-covering member 35 has a cleaning means for cleaning the glass dust cover 30. The image forming apparatus in this embodiment is structured so that the cleaning-and-covering member 35 or glass dust cover 30 is moved relative to each other by the movement of the separating means to make the cleaning-and-covering member 35 to clean the glass dust cover 30.

The cleaning-and-covering 35 is made up of a base plate 36 (36*a*, 36*b*, 36*c*, and 36*d*) and a bundles of bristles 37 (37*a*, 37*b*, 37*c*, and 37*d*). The base plate 36 is in a form of a long and narrow rectangle, and the bristles 37 are planted on the glass dust cover side of the base plate 36. The cleaning-and-covering member 35 is kept pressed toward the top surface of the scanner unit 3 by unshown compression springs. It is attached to the optical unit case in such a manner that it can be moved with its bristles 37 remaining in contact with the glass dust cover 30. It is movable between a position A in which it keeps the glass dust cover 30 covered, and a position B in which it leaves the glass dust cover 30 exposed. The apparatus main assembly 100A is provided with cams 82 (82*a*, 82*b*, 82*c*, and 82*d*) for moving the cleaning-and-covering member 35; there are a pair of cams 82, per cleaning-and-covering member 35, located at the lengthwise ends of the cleaning-and-covering member 35, one for one. The cam 82 is coaxial with the separation cam 80. Further, the cleaning-and-covering member 35 is provided with a cam follower portion 83 (83*a*, 83*b*, 83*c*, or 83*d*). The cam 82 rotates with the separation cam 80. As the cam 82 rotates, the cleaning-and-covering member 35 is moved by the rotation of the cam 82 through the cam follower portion 83, between the position A in which its keeps the glass dust cover 30 covered, and the position B in which it leaves the glass dust cover 30 exposed.

Figure 11:
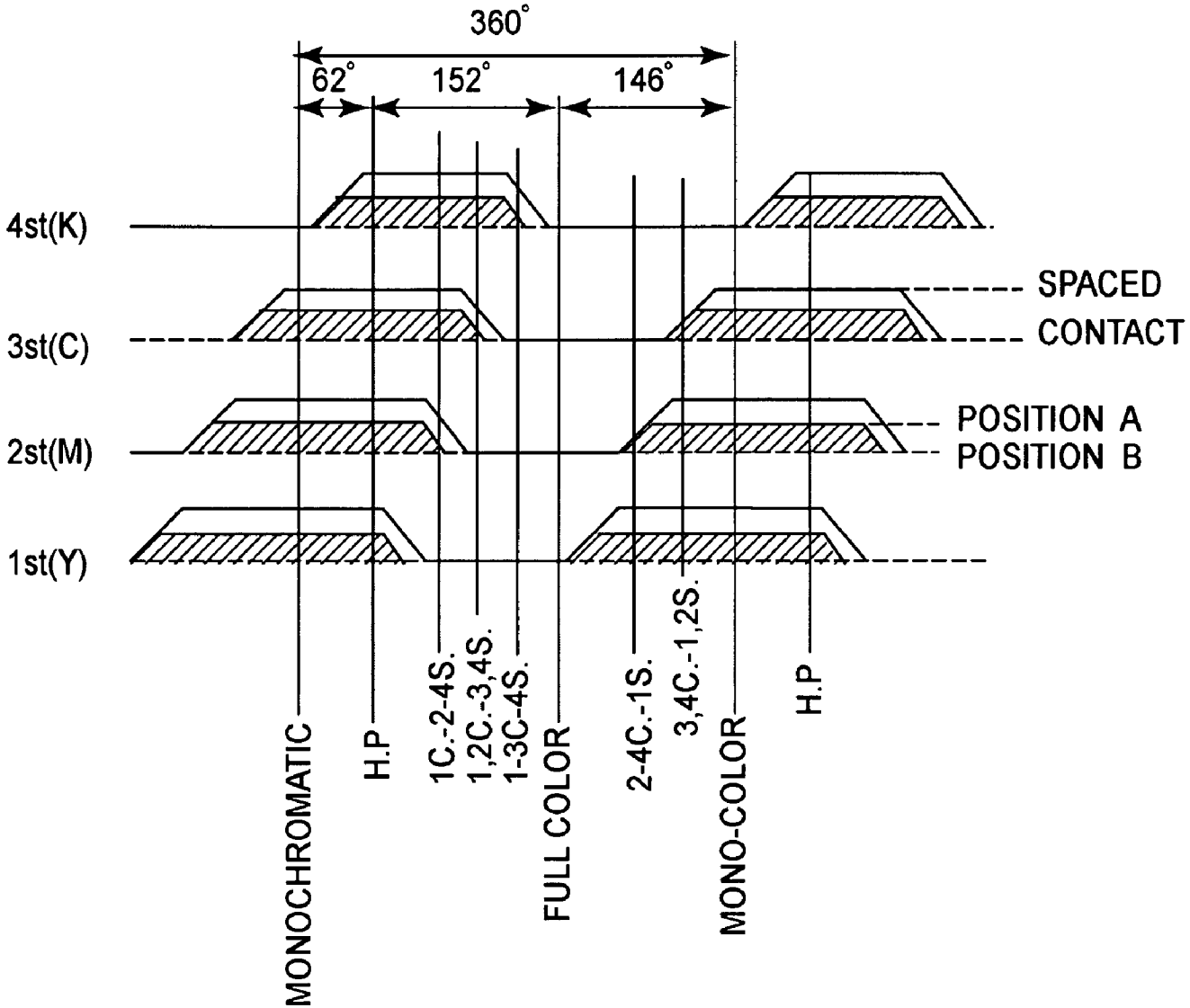
FIG. 11 is a schematic drawing showing the relationship between the rotational phase of the separation cam, and the position of the cleaning-and-covering member.

As will be evident from FIG. 11 which shows the relationship in rotational phase between the separation cam 80 and cam 82, and the position of the cleaning-and-covering member 35, the cam 82 is made different in profile from the separation cam 80. In FIG. 11, 1st-4th correspond to the first to fourth cartridges 7*a*, 7*b*, 7*c*, and 7*d*.

More concretely, the image forming apparatus is structured so that the cleaning-and-covering member 35 is moved from the exposure position B to the blocking position A before the operation for separating the development roller 41 from the photosensitive drum 1 is completed. That is, before the development roller 41 is separated from the photosensitive drum 1, the cleaning-and-covering members 35 are selectively moved.

Therefore, it is possible to better prevent the problem that the contaminants, such as the toner particles having scattered or fallen from the cartridge 7 when the development roller 41 is separated from the photosensitive drum 1, adhere to the glass dust cover 30. That is, this embodiment is more effective than the first embodiment in terms of the prevention of the problem that an image forming apparatus is reduced in image quality by the adhesion of the toner particles and/or dust to the glass dust cover 30.

Further, in this embodiment, the cams 82 which are different in profile from the separation cams 80 are provided in addition to the separation cams 80, in order to move the cleaning member after the development roller 41 is separated from the photosensitive drum 1. Therefore, the contaminants having adhered to the surface of the glass dust cover 30 during the separation of the development roller 41 are immediately removed.

As described above, this embodiment also makes it possible to clean or keep covered the glass dust cover 30 with the employment of a simple structural arrangement, by utilizing the operation for separating the developing apparatus from the photosensitive drum 1, as does the first embodiment.

This embodiment also is not intended to limit the present invention in scope, unless specifically noted. For example, instead of the bundles of bristles 37 used in this embodiment, a cleaning pad, a piece of sponge, or the like, may be used to clean the glass dust cover 30.

Further, instead of structuring an image forming apparatus so that the cleaning member 31 is moved to clean the glass dust cover 30, an image forming apparatus may be structured so that the cleaning member 35 remains stationary, and the contaminants of the glass dust cover 30 are removed by moving the glass dust cover 30 relative to the stationary cleaning member 35 by the movement of the development unit 40 caused by the separating means 90 in the direction to separate the developing apparatus from the photosensitive drum 1, and the movement of the development unit 40 caused by the separating means 90 in the direction to place the developing apparatus in contact with the photosensitive drum 1. That is, the gist of the present invention is to clean the glass dust cover 30 by moving the cleaning member 35 or glass dust cover 30 relative to each other, by the utilizing the operation of the separating means 90.

Embodiment 3

In the first embodiment of the present invention, the image forming apparatus was structured so that the developing apparatus 4 was separated from, or placed in contact with, the photosensitive drum 1 by moving the separation boss 46 of the process cartridge 7 leftward or rightward by placing the separation cam 80, which is rotated to separate the developing apparatus 4 from the photosensitive drum 1 or to allow the developing apparatus 4 to be placed in contact with the photosensitive drum 1, in contact with the separation boss 46 of the process cartridge 7. In this embodiment, the image forming apparatus is provided with a rotational cam linkage used to separate the developing apparatus from the photosensitive drum 1 or place the developing apparatus in contact with the photosensitive drum 1. Next, this embodiment will be described with reference to FIGS. 12-13. First, referring to FIG. 12, the image forming apparatus 200 in this embodiment is structured so that when the cartridge 7 (7*a*-7*d*) is mounted into the apparatus 200, it is guided by the guiding member 105 (105*a*, 105*b*, 105*c*, or 105*d*) in a direction D which is parallel to the axial line of the photosensitive drum 1. The separating means is made up of a cam and a linkage. The linkage is movable with the rotation of the cam to move the above-mentioned guiding members 105. Otherwise, the structure of the image forming apparatus in this embodiment is the same as that of the image forming apparatus in the first embodiment. Thus, the structural components of this image forming apparatus, which are similar to the counterparts of the image forming apparatus in the first embodiment, will be given the same referential symbols, as those given to the counterparts in the first embodiment, one for one, to avoid the repetition of the same description. Also in terms of general structure, this image forming apparatus is the same as the image forming apparatus in the first embodiment. Therefore, the general structure of this image forming apparatus also will not be described.

Figure 12:
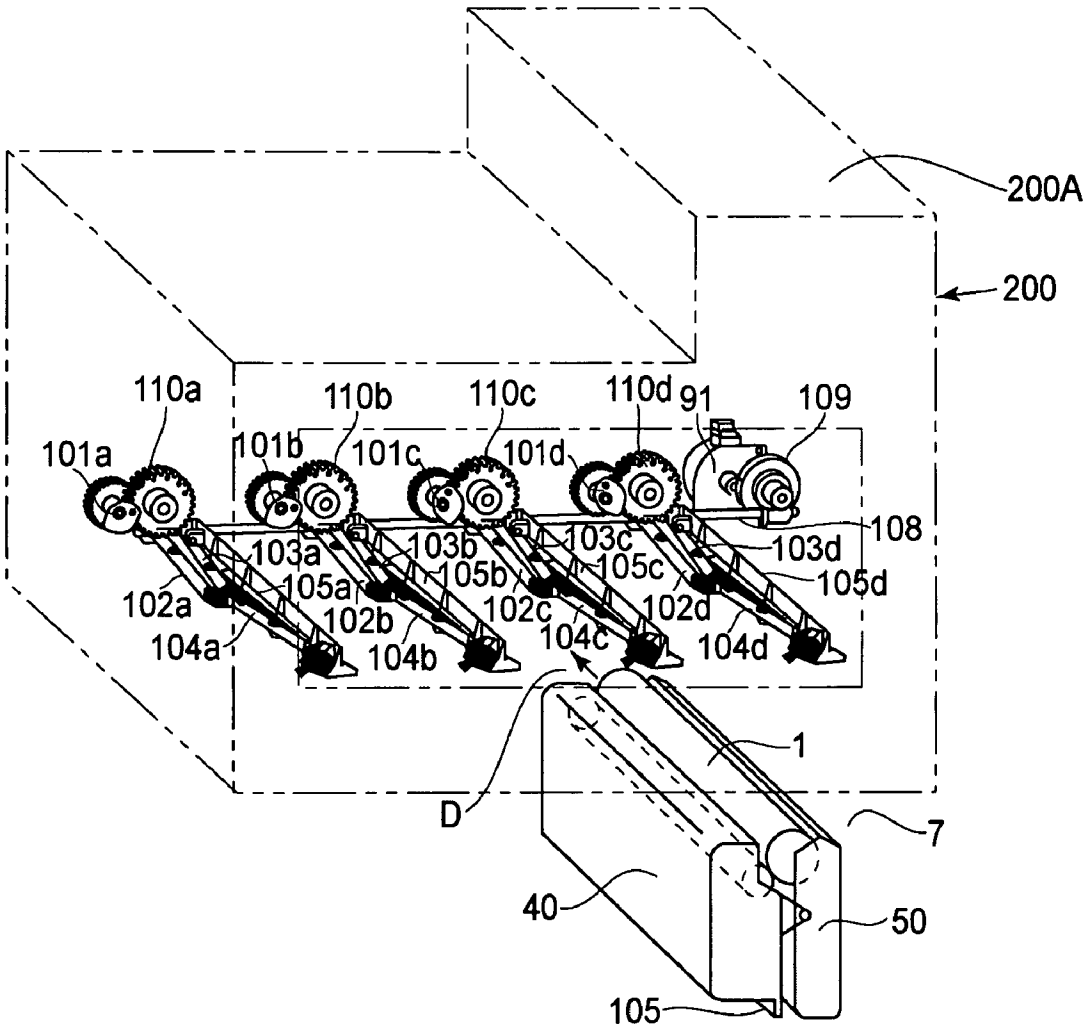
FIG. 12 is a detailed perspective view of the mechanism for placing the developing apparatus in contact with the photosensitive member, or separating the developing apparatus from the photosensitive member, in particular, the rotational cams and linkage portions thereof, in the third embodiment.

The structure of the aforementioned linkage in this embodiment is shown in FIG. 12. More specifically, the rotation of the stepping motor 91 is transmitted to the clutch 110 (110*a*, 110*b*, 110*c*, or 110*d*) through a gear 109 and a rod 108. While the clutch 110 remains engaged, the driving force from the stepping motor 91 is transmitted to a rotational cam 101

(101*a*, 101*b*, 101*c*, and 101*d*) through the clutch 110. When the clutch 110 remains disengaged, the driving from the stepping motor 101 is not transmitted to the rotational cam 101 through the clutch 110. As the clutch 110 is engaged, the rotational cam 101 is rotated, coming into contact with one end of a first member 102 (102*a*, 102*b*, 102*c*, and 102*d*) of the linkage. The first linkage member 102 is supported so that it can be rocked about its point of support. The opposite end of the first linkage member 102 is in connection with one end of each of two other linkage members, that is, a second linkage member 103 (103*a*, 103*b*, 103*c*, or 103*d*) and a third linkage member 104 (104*a*, 104*b*, 104*c*, or 104*d*). Further, the second and third linkage members 103 and 104 are in connection with the guiding member 105 (105*a*, 105*b*, 105*c*, or 105*d*), which also function as a covering (blocking) means, by their opposite ends from the ends by which they are in connection with the first linkage member 102. Thus, as the stepping motor 91 is turned on, the driving force from the stepping motor 91 moves leftward or rightward the two ribs 106 (106*a*, 106*b*, 106*c*, or 106*d*), with which the development unit 40 of each cartridge 7 is provided, through the guiding member 105. As a result, the development unit 40 is moved into the separation position in which it keeps the development roller 41 from the photosensitive drum 1, or into the contact position in which it leaves the development roller in contact with the photosensitive drum 1. When the development unit 40 is in the separation position, the guiding member 105 is in the covering (blocking) position in which it keeps blocked the path of the image writing beam of light outputted from the scanner unit 3. When the development unit 40 is in the contact position, the guiding member 105 is in the exposure position in which it leaves unblocked the path of the image writing beam of light outputted from the scanner unit 3.

Also in this embodiment, the image forming apparatus can be placed in the following three operational modes by controlling the rotational angle of the rotational cam 101, as in the first embodiment.

Mode a (Standby Mode): The portion of the peripheral surface of the separation cam 101 of each of the first to fourth cartridges 7, which corresponds to the portion of the separation cam 101, which is largest in radius, is placed in contact with one end of the corresponding first linkage member 102, whereby the development roller 41 is kept separated from the photosensitive drum 1, as in FIGS. 13(*a*) and 14A, to keep the image forming apparatus in the standby mode.

Figure 13:
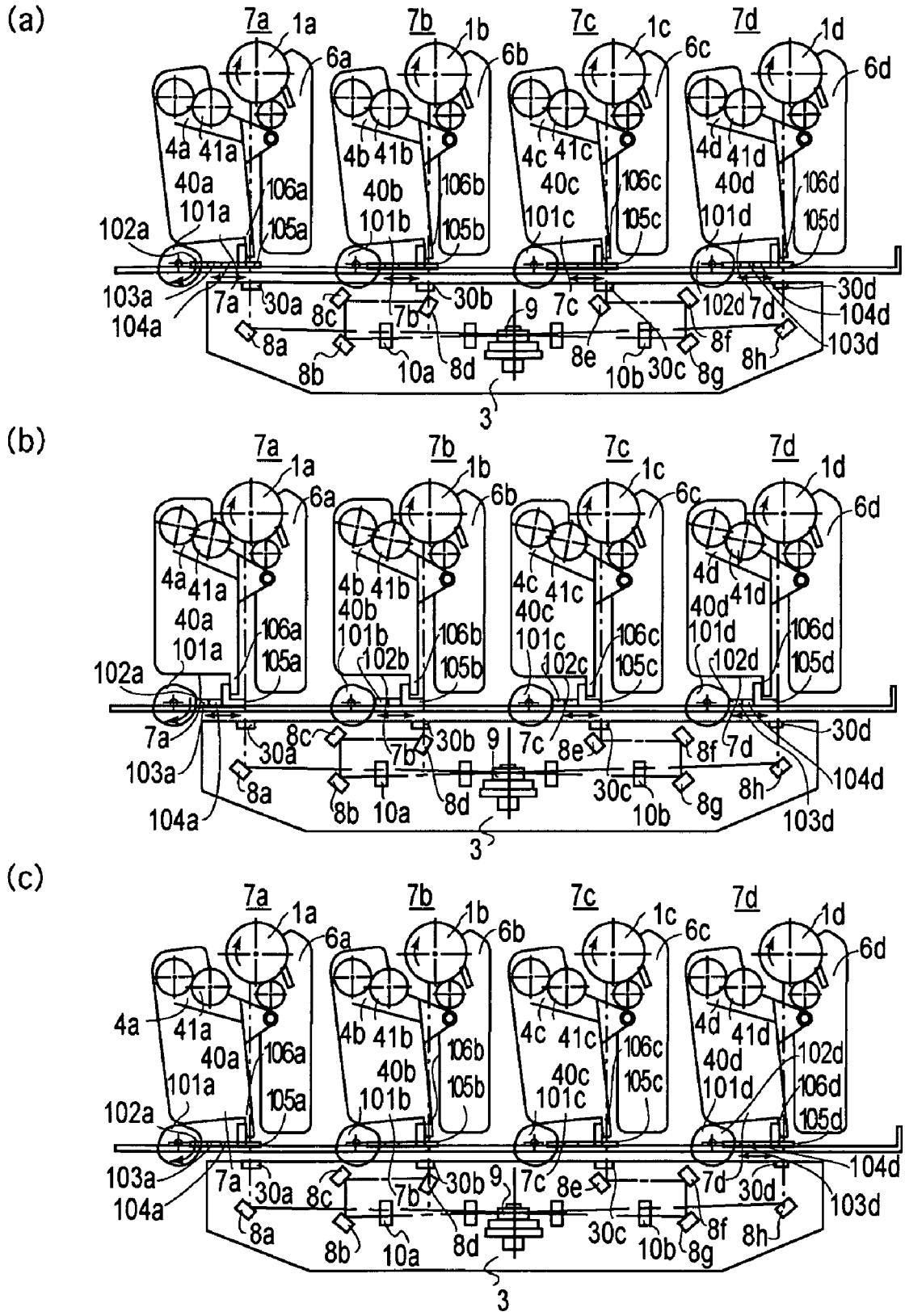
FIGS. 13(*a*), 13(*b*), and 13(*c*) are schematic sectional views of the image forming portions of the image forming apparatus, when the image forming apparatus is on standby, when the image forming apparatus is forming an image in the full-color mode, and when the image forming apparatus is forming an image in the black-and-white mode, respectively.

Mode b (Full-Color Mode): The portion of the peripheral surface of the separation cam 101 of each of the first to fourth cartridges 7, which corresponds to the portion of the separation cam 101, which is smallest in radius, is placed in contact with one end of the corresponding first linkage member 102, whereby the development roller 41 is allowed to remain in contact with the photosensitive drum 1, as shown in FIGS. 13(*b*) and 14B, to keep the image forming apparatus 100 in the full-color mode.

Mode c (Black-and-White Mode): The portion of the peripheral surface of the separation cam 101 of each of the first to third cartridges 7 (for yellow, magenta, and cyan color, respectively), which corresponds to the portion of the separation cam 101, which is largest in radius, is placed in contact with one end of the corresponding first linkage member 102, whereby the development roller 41 is kept separated from the photosensitive drum 1, as in FIG. 13(*c*) and 14A, whereas, the portion of the peripheral surface of the separation cam 101 of the fourth cartridge 7 (for black color), which corresponds to the portion of the separation cam 101, which is smallest in radius, is placed in contact with one end of the corresponding first linkage member 102, as shown in FIG. 13(*c*), to keep the image forming apparatus 100 in the black-and-white mode, in which the development roller 41 of the fourth cartridge 7 (for black color) is kept in contact with the corresponding photosensitive drum 1.

In the full-color mode, the development rollers 41*a*, 41*b*, 41*c*, and 41*d* of the first (yellow), second (magenta), third (cyan), and fourth (black) cartridges 7 are sequentially placed in contact with the corresponding photosensitive drums 1, in the listed order, to develop the electrostatic latent images on the photosensitive drums 1, respectively. Then, as the development of the electrostatic latent images on the corresponding photosensitive drums 1 are sequentially completed, respectively, the development rollers 41*a*, 41*b*, 41*c*, and 41*d* of the first (yellow), second (magenta), third (cyan), and fourth (black) cartridges 7 are sequentially separated from the corresponding photosensitive drums 1, in the listed order, ending thereby the printing operation. That is, the first to fourth cartridges 7 are made different in the rotational phase of the separation cam 101 in the same manner as the first to fourth cartridges 7 are made different in the timing with which their separation cams 101 are rotated into the separation position, or rotated out of the separation position; the separation cams 101*a*, 101*b*, 101*c*, and 101*d* are made different in rotational phase.

Further, the means for driving the development roller 41 is provided with the development clutch (not shown) to make it possible to start rotating the development roller 41 or to stop the development roller 41 even when the photosensitive drum 1 is rotating.

In this embodiment, the image forming apparatus is structured so that the first to third cartridges 7*a* (Y), 7*b* (M), and 7*c* (C) are driven by two motors, whereas the fourth cartridge 7*d* is driven by a single motor independent from the two motors which drive the first to third cartridge 7*a* (Y), 7*b* (M), and 7*c* (C). More specifically, the photosensitive drums 1 of the first to third cartridges 7*a* (Y), 7*b* (M), and 7*c* (C) are driven by a single photosensitive member driving means having a single motor, whereas the development rollers 41 of the first to third 7*a* (Y), 7*b* (M), and 7*c* (C) are driven by another driving means, that is, a developing apparatus driving means having a single motor. In comparison, the photosensitive drum driving means and developing apparatus driving means of the fourth cartridge 7*d* share a single motor. Thus, in the black-and-white mode, only a single motor is used.

With the employment of the above-described structural arrangement, the development roller 41 begins to be driven only when a toner image on the photosensitive drum 1 needs to be developed. Then, the development roller 41 is placed in contact with the photosensitive drum 1. When the image forming apparatus 100 is not forming an image, the separating means 90 keeps the development roller 41 separated from the photosensitive drum 1, minimizing thereby the amount by which the surface layer of the photosensitive drum 1 is shaved by the development roller 41, and also, minimizing the amount by which the development roller 41 deteriorates.

Further, when the cartridge 7 is mounted or dismounted, the developing apparatus moving mechanism is in the state shown in FIGS. 13(*a*) and 14B, that is, the state in which the development rollers 41 in all cartridges 7 remain separated from the corresponding photosensitive drum 1. Therefore, the light paths for the exposing means remain blocked by the guiding members 105 (105*a*, 105*b*, 105*c*, and 105*d*); the guiding members 105 are in their blocking positions.

The image forming apparatus is structured so that when the cartridge 7 is pulled out, the cartridge 7 is guided (regulated) by the ribs, with which the guiding member 105 (covering/blocking member) is provided, by the ribs with which the development unit 40 is provided, in order to ensure that the development roller 41 remains separated from the photosensitive drum 1.

Further, the guiding ribs with which the dust cover 105 is provided is tapered so that its front end (in terms of direction in which it is inserted) is narrower, that is, it is shaped to cause the development unit 40 of the cartridge 7 to be reliably placed in the position in which the development roller 41 is kept separated from the photosensitive drum 1. Therefore, when the cartridge 7 is inserted, the development roller 41 is automatically separated from the photosensitive drum 1.

As described above, the covering (blocking) means doubles as a guiding means for guiding the process cartridge 7 when the cartridge 7 is removably mounted into the apparatus main assembly 100A.

This embodiment also is not intended to limit the present invention in scope unless specifically noted. For example, the linkage may be reversed in the position of connection between the rotational cam and linkage. In other words, the three linkage arms may be connected in series so that their joints come into contact with the process cartridge.

Embodiment 4

In the third embodiment, the image forming apparatus was structured so that the process cartridges 7 are horizontally arranged in tandem. In this embodiment, the process cartridges 7 are arranged in tandem at an angle of θ relative to the horizontal plane F.

[General Structure of Image Forming Apparatus]

Figure 15:
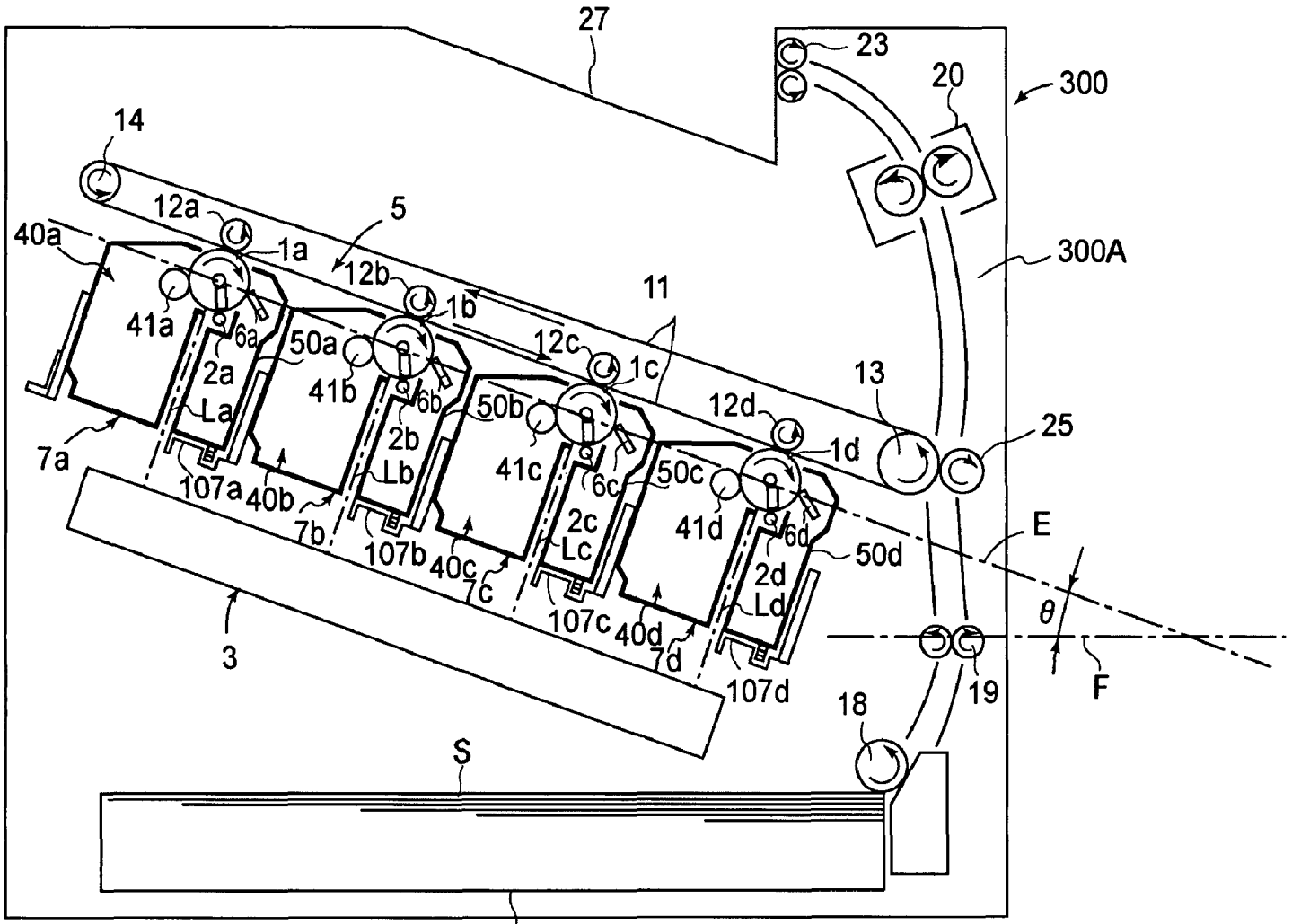
FIG. 15 is a schematic sectional view of the image forming apparatus in the fourth embodiment of the present invention.

Referring to FIG. 15, an image forming apparatus 300 is an electrophotographic image forming apparatus. More specifically, it is a full-color laser beam printer which uses four toners different in color. It forms a color image on a recording medium. Further, this image forming apparatus 300 is structured so that four process cartridges 7, that is, first to four process cartridges 7*a*, 7*b*, 7*c*, and 7*d*, are removably mountable in its main assembly 300A.

Referring to FIG. 15, designated by a referential symbol E is a hypothetical plane which coincides with the rotational axis of the drum 3 of each cartridge 7, and it is assumed that the angle of this plane relative to the horizontal plane F is θ. In this embodiment, the value of this angle θ is roughly 20°. Arranging multiple cartridges 7 in tandem at an angle relative to the horizontal plane can reduce the apparatus main assembly 300A in dimension in terms of the direction perpendicular to the axial line of the photosensitive drum 1.

The structure of the cartridge 7 in this embodiment is the same as that in the third embodiment. Therefore, it will not be described here.

Also in this embodiment, the exposing means (which in this embodiment is exposing means 302) for exposing the photosensitive drum 1 is positioned below the space in which the cartridges 7 are mounted.

There is an intermediary transfer unit 5 above the space in which the cartridges 7 are mounted. This unit 5 is a transferring means for transferring in layers (primary transfer) the toner images formed on the drums 3 of the first to fourth cartridges 7, one for one, onto its intermediary transfer belt 11 (which hereafter will be referred to simply as transfer belt 11). This unit 5 has the above-mentioned transfer belt 11, a driver roller 13, and a tension roller 14. Referring to FIG. 15, the driving roller 13 and tension roller 14 are on the right and left sides, respectively, of the drawing, and are parallel to each other. The transfer belt 11 is a flexible endless belt, and is suspended by the driving roller 13 and tension roller 14, being stretched between the two rollers 13 and 14. Further, this unit 5 is positioned so that its transfer belt 11 is slanted relative to the horizontal plane.

Figure 16:
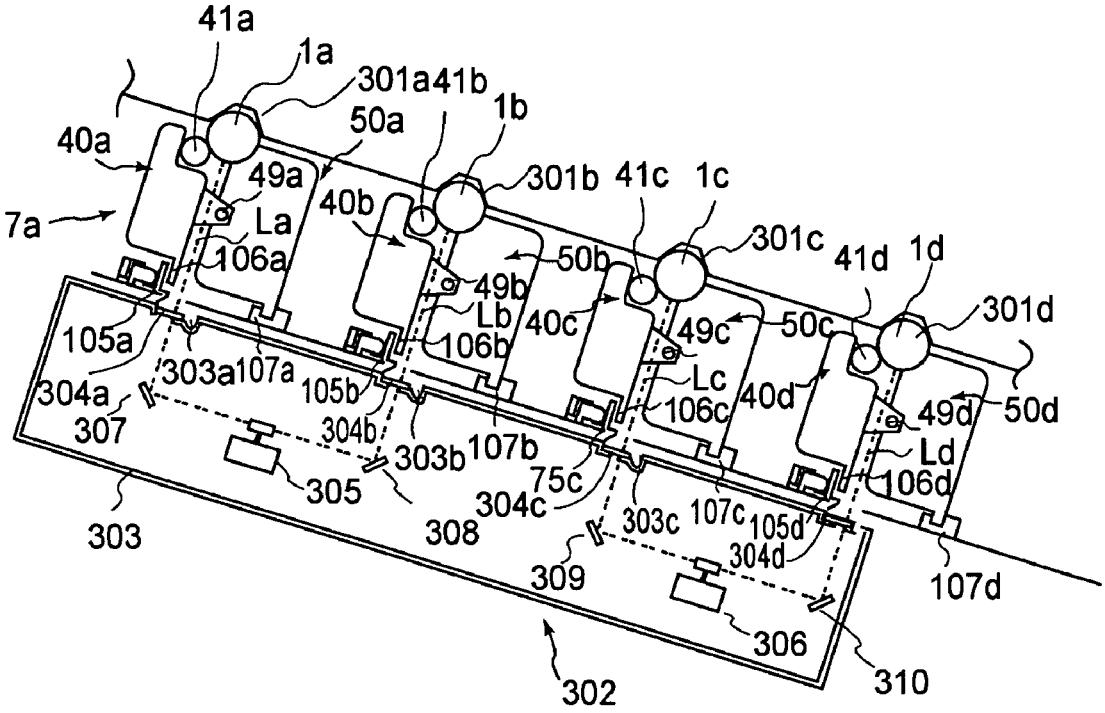
FIG. 16 is an enlargement of one of the essential portions of FIG. 15 when the developing apparatus is in contact with the photosensitive member.

When the process cartridge 7 is mounted into, or dismounted from, the apparatus main assembly 300A, it is guided by the guiding members 105 (105*a*-105*d*) in the direction parallel to the axial line of the drum 3, as it is in the third embodiment. Next, referring to FIG. 16, as each process cartridge 7 is inserted into the apparatus main assembly 300A, the bearing portion (not shown) with which the lengthwise ends of the drum 3, in terms of the axial line of the drum 3, comes into contact with the cartridge positioning portion 301 (301*a*, 301*b*, 301*c*, or 301*d*), precisely positioning thereby the cartridge 7 relative to the apparatus main assembly 300A. Also as the process cartridge 7 is inserted into the apparatus main assembly 300A, its drum unit 50 is pressed by the supporting member 107 (107*a*, 107*b*, 107*c*, or 107*d*), being thereby precisely positioned relative to the apparatus main assembly 300A, and the rib 106 (106*a*, 106*b*, 106*c* or 106*d*) with which the development unit 40 is provided is separated from the guiding member 105. The guiding member 105 in this embodiment is also a part of the separating means for moving the development unit 40 into the position in which it keeps the development roller 41 (41*a*, 41*b*, 41*c*, or 41*d*) separated from the drum 3, as does the guiding member 105 in the third embodiment. That is, when the rib 106 and guiding member 105 remain separated from each other as shown in FIG. 16, the springs (not shown) placed between the development unit 40 and drum unit 50 keep the development unit 40 in the position in which it keeps the development roller 41 in contact with the photosensitive drum 3. As the guiding member 105 is moved in the direction indicated by an arrow mark 312 (FIG. 17), the rib 106 is pushed by the guiding member 105, causing thereby the development unit 40 to rotate about the connective pins 49 (rotational axis of development unit 40) into the position in which it keeps the development roller 41 separated from the photosensitive drum 3. The separating mechanism, in this embodiment, for moving the guiding member 105 is the same as that in the third embodiment, and therefore, will not be described here.

Figure 17:
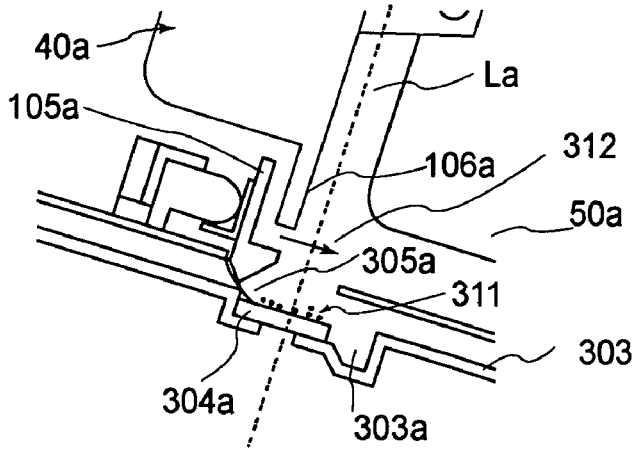
FIG. 17 is an enlarged view of the development roller separating means, and transparent member, when the developing apparatus is in contact with the photosensitive member, in the fourth embodiment.
Figure 18:
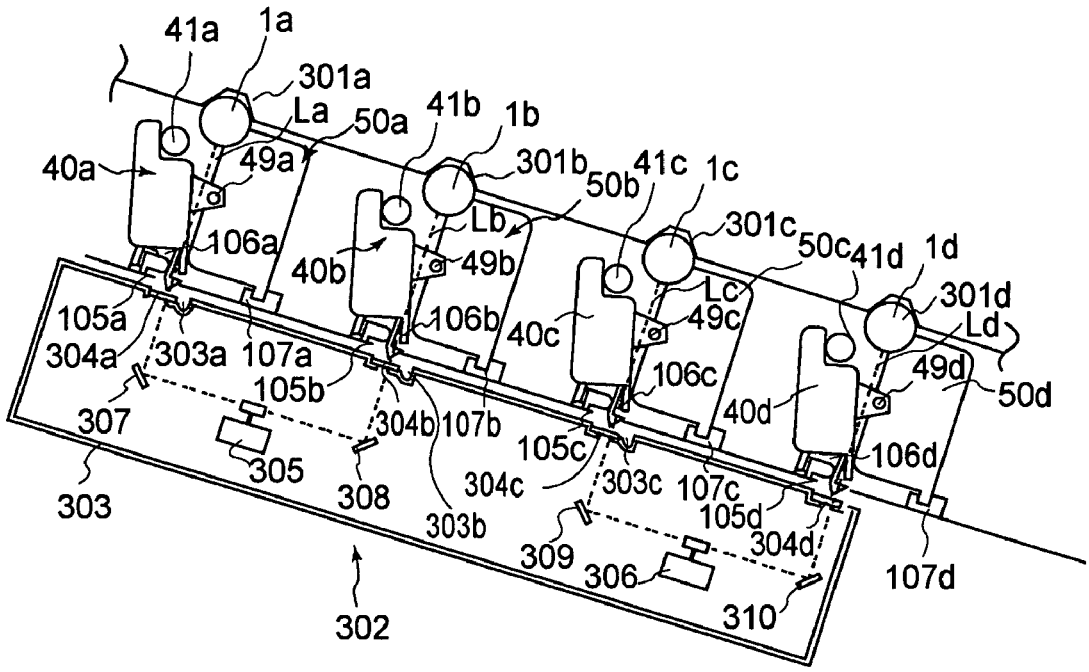
FIG. 18 is an enlargement of one of the essential portions of FIG. 15 when the developing apparatus is not in contact with the photosensitive member.
Figure 19:
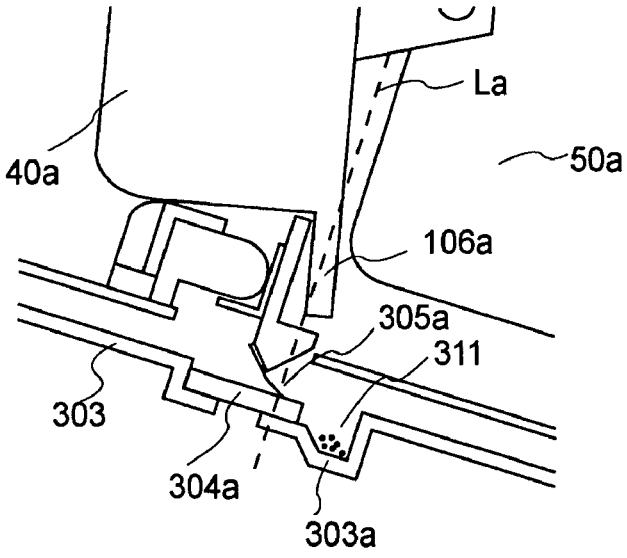
FIG. 19 is an enlarged view of the development roller separating means, and transparent member, when the developing apparatus is not in contact with the photosensitive member, in the fourth embodiment.

Next, referring to FIGS. 17 and 19, the guiding member 105 in this embodiment is provided with a cleaning sheet 305 (305*a*-305*d*) for cleaning a glass 303 (303*a*-303*d*), that is, a transparent member through which the beam of light emitted from an exposing means 302 transmits. The cleaning sheet 305 is a flexible sheet formed of polyethylene-terephthalate. As the guiding member 105 moves in the direction indicated by the arrow mark 312, the cleaning sheet 305 moves the foreign substances 311 having adhered to the glass 303, into a storage portion 303 (303*a*-303*d*) with which the frame of the exposing means 302 is provided. In this embodiment, the exposing means 302 is also tilted relative to the horizontal plane H. Therefore, the gravity can be utilized to more effectively store the foreign substances 311 having adhered to the glass 303 into the storage portion 303*a* by the movement of the guiding member 105 than in the preceding embodiments in which the exposing means were horizontally positioned. Incidentally, the foreign substances 311 having adhered to the glass 303 are the toner particles having fallen from the cartridge 7, dust floating in the interior of the apparatus main assembly 300A, etc., as described above. Further, the image forming apparatus 300 is structured so that the guiding member 105 doubles as the member for blocking or unblocking the beam of light emitted from the exposing means 302. That is, when the guiding member 105 is in the position shown in FIG. 17, it does not block the light passage L (La-Ld), whereas when it is in the position shown in FIG. 19, it keeps the light path L blocked. That is, as in the third embodiment, when the cartridge 7 is mounted or dismounted, the guiding member 105 is in the position shown in FIG. 18 or the position shown in FIG. 19, respectively. Therefore, when the cartridge 7 is pulled out, the rib 106 of the development unit 40 is regulated by the guiding member 105, keeping thereby the development unit 40 in the separation position.

Figure 14A:
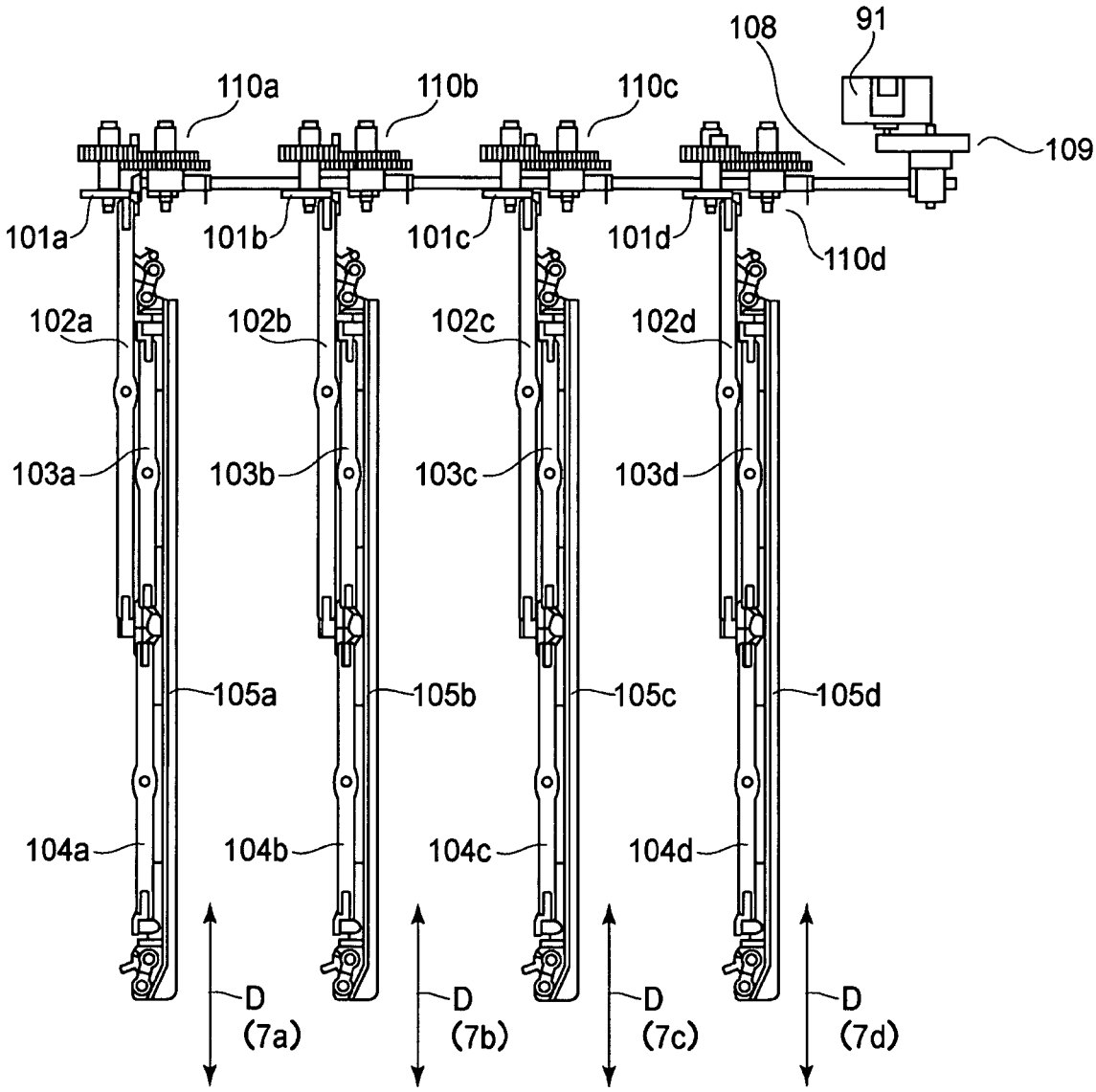
FIGS. 14A and 14B are detailed top views of the rotational cam linkage portion of the mechanism for placing the development rollers in contact with, or separating them from, the corresponding photosensitive drums, in the third embodiment, when the development roller is in contact with the photosensitive drum, and when it is not in contact with the photosensitive drum, respectively.
Figure 14B:
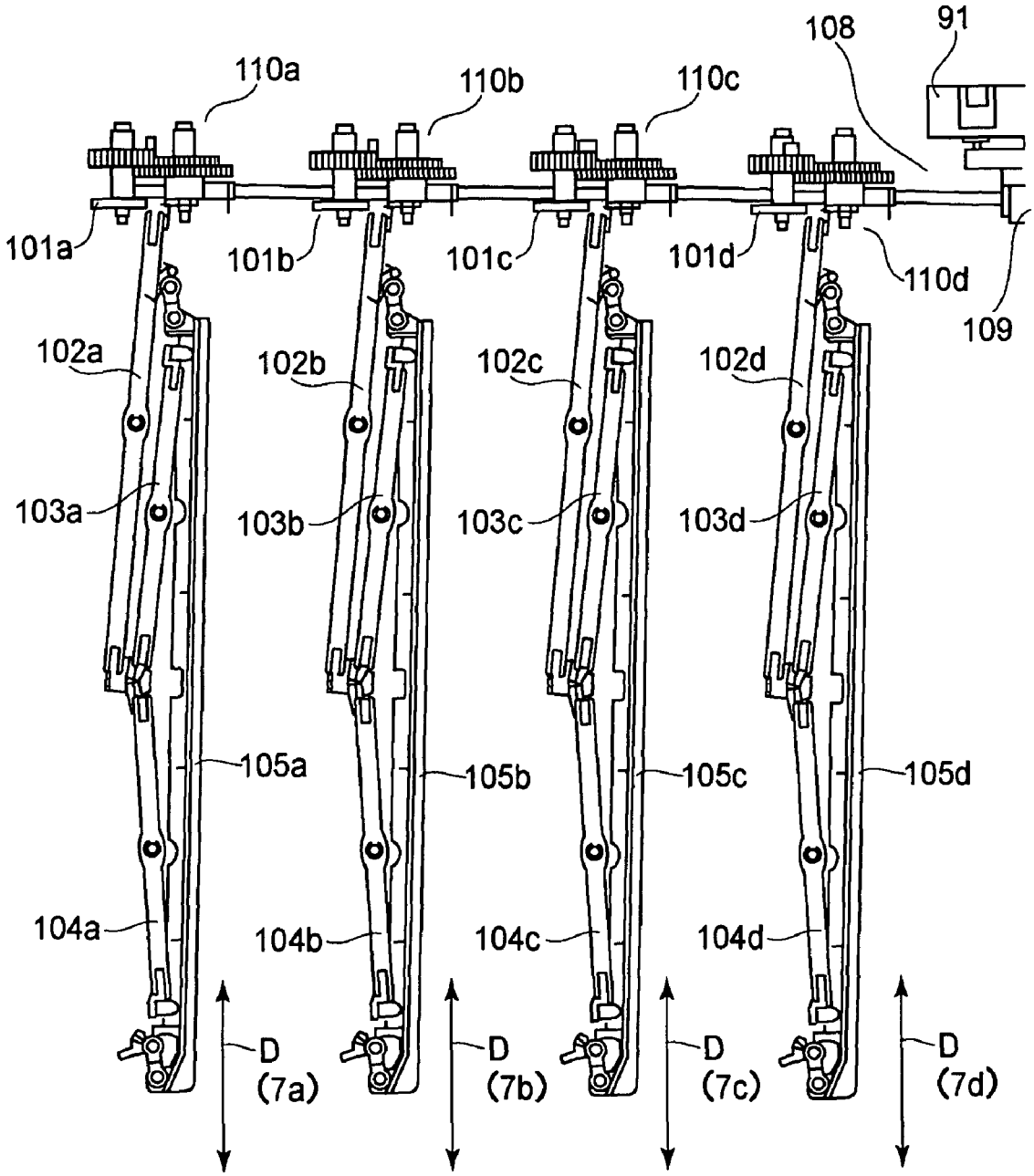

Further, the guiding rib of the guiding member 105 is tapered so that its front portion, in terms of the insertion direction, is smaller than its rear portion (FIG. 14A), ensuring thereby that as the cartridge 7 is insert into the apparatus main assembly 300A, the development unit 40 is automatically moved into the separation position. Therefore, it does not occur that toner adheres to the glass 303 when the cartridge 7 is mounted or dismounted.

As will be evident from the preceding description of the first to fourth embodiments of the present invention, according to the present invention, the separating means, which is the means for inputting the force for separating the developing apparatus (developer bearing member) from the photosensitive drum, or placing the developing apparatus in contact with the photosensitive drum, doubles as the means for inputting the force for moving the glass dust cover cleaning-and-covering (light blocking) member. Therefore, it is unnecessary to provide the image forming apparatus with an additional driving force source, that is, the driving force source for driving the glass dust cover cleaning-and-covering (light blocking) member. Thus, the present invention makes it possible to provide an image forming apparatus which is inexpensive, and yet, is superior in optical properties related to the scanning of a photosensitive drum with a beam of light than an image forming apparatus in accordance with the prior art. Also according to the present invention, the operation for placing the developing apparatus in contact with the image bearing member, or separating the developing apparatus from the image bearing member, causes the glass dust cover to be cleaned. In other words, the present invention makes it possible to more efficiently remove the contaminants on the glass dust cover, that is, the powdery debris and/or toner particles having fallen onto the glass dust cover during image formation than the prior art.

Also according the present invention, carrying out the operation for placing the developing apparatus in contact with the image bearing member, or separating the developing apparatus from the image bearing member, causes the path of the image forming beam of laser light to be blocked or unblocked, respectively. Therefore, it does not occur that powdery debris which is created during an image forming operation or when a cartridge is mounted or dismounted, and/or the toner particles which scatter from the cartridge during an image forming operation or when the cartridge is mounted or dismounted, fall onto the glass dust cover and/or other optical components and adhere thereto.

Further, the glass dust cover is cleaned after the operation for separating the developing apparatus from the image bearing member is completed. Therefore, the present invention is more effective than the prior art, in terms of keeping the glass dust cover or other optical components, free of the contamination which is attributable to the toner particles which scatter from a process cartridge when the developing apparatus is separated from the image bearing member, and/or the powder debris which is created when the developing apparatus is separated from, or placed in contact with, the image bearing member.

Further, the glass dust cover is covered before the operation for separating the developing apparatus from the image bearing member is completed. Therefore, it is possible to prevent the problem that the contaminants, such as the toner particles having scattered from the cartridge when the developing apparatus was separated from the image bearing member, falls onto the glass dust cover and adhere thereto.

That is, according to the present invention, which relates to an image forming apparatus in which a process cartridge whose photosensitive drum and development roller can be placed in contact with each other, or separated from each other, the separating means of the image forming apparatus is utilized to prevent the problem that toner adheres to the transparent member and exposing member of the apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 129251/2007 and 077498/2008 filed May 15, 2007 and Mar. 25, 2008 which are hereby incorporated by reference.

What is claimed is:

1. An image forming apparatus for forming an image on a recording material, to which a process cartridge is detachably mountable, wherein the process cartridge includes a photosensitive drum unit and a developing unit, wherein the photosensitive drum unit includes a photosensitive drum, and the developing unit is rotatably engageable with the photosensitive drum unit and includes a developing roller for developing an electrostatic latent image formed on the photosensitive drum, and wherein the developing unit is movable between a contact position in which the developing roller is in contact to the photosensitive drum and a spaced position in which the developing roller is spaced from the photosensitive drum, said apparatus comprising:

exposure means for exposing the photosensitive drum with light through a transmission member to form the electrostatic latent image, wherein the exposure means is positioned below the process cartridge when the process cartridge is mounted to a main assembly of the apparatus;

moving means for moving the developing unit to the contact position or to the spaced position; and a cleaning member for cleaning said transmission member in interrelation with an operation of said moving means.

2. An apparatus according to claim 1, wherein said cleaning member is provided on said moving means.

3. An apparatus according to claim 1, wherein said exposure means is provided with an accommodating portion for accommodating deposited matter removed from said transmission member by said cleaning member.

4. An apparatus according to claim 1, wherein the moving means is provided with a guide portion for demountably mounting the process cartridge to said main assembly of said apparatus.

5. An apparatus according to claim 1, wherein said cleaning member is movable to clean said transmission member in interrelation with the operation of said moving means before the developing unit moves to the spaced position.

6. An apparatus according to claim 1, wherein said cleaning member is movable to clean said transmission member in interrelation with the operation of said moving means after the developing unit moves to the spaced position.

7. An apparatus according to claim 3, wherein said apparatus is a color image forming apparatus to which a plurality of such process cartridges are detachably mountable, and said exposure means is inclined relative to a horizontal plane.

8. An apparatus according to claim 1, wherein when the process cartridge is mounted to said main assembly of said apparatus, said cleaning member is engaged with the developing unit to move with movement of the developing unit.

9. An image forming apparatus for forming an image on a recording material, to which a process cartridge is detachably mountable, wherein the process cartridge includes a photosensitive drum unit and a developing unit, wherein the photosensitive drum unit includes a photosensitive drum, and the developing unit is rotatably engageable with the photosensitive drum unit and includes a developing roller for developing an electrostatic latent image formed on the photosensitive drum, and wherein the developing unit is movable between a contact position in which the developing roller is in contact to the photosensitive drum and a spaced position in which the developing roller is spaced from the photosensitive drum, said apparatus comprising:

exposure means for exposing the photosensitive drum with light to form the electrostatic latent image, wherein said exposure means is positioned below the process cartridge when the process cartridge is mounted to a main assembly of said apparatus;

moving means for moving the developing unit to the contact position or to the spaced position; and a blocking member movable in interrelation with an operation of said moving means, wherein when the developing unit is at the contact position, the blocking member opens an optical path for the light, and when the developing unit is at the spaced position, said blocking member is positioned at a blocking position to block the optical path to receive the developer.

10. An apparatus according to claim 9, further comprising a transmission member for transmitting the light, wherein said blocking member is provided with a cleaning member for cleaning said transmission member.

11. An apparatus according to claim 9, wherein said blocking member is provided with a guide portion for demountably mounting the process cartridge relative to said main assembly of said apparatus.

12. An apparatus according to claim 11, wherein the process cartridge is capable of being mounted and demounted when said blocking member is at the blocking position.

13. An apparatus according to claim 10, wherein said cleaning member is movable to clean said transmission member in interrelation with the operation of said moving means before the developing unit moves to the spaced position.

14. An apparatus according to claim 10, wherein said cleaning member is movable to clean said transmission member in interrelation with the operation of said moving means after the developing unit moves to the spaced position.

15. An apparatus according to claim 10, wherein said apparatus is a color image forming apparatus to which a plurality of such process cartridges are detachably mountable, and said exposure means is inclined relative to a horizontal plane.

16. An apparatus according to claim 10, wherein when the process cartridge is mounted to said main assembly of said apparatus, said cleaning member is engaged with the developing unit to move with movement of the developing unit.

* * * * *